US010111017B2

(12) United States Patent
Hillbratt et al.

(10) Patent No.: US 10,111,017 B2
(45) **Date of Patent: *Oct. 23, 2018**

(54) CONTROL TECHNIQUES BASED ON OWN VOICE RELATED PHENOMENA

(71) Applicant: Cochlear Limited, Macquarie University, NSW (AU)

(72) Inventors: Martin Evert Gustaf Hillbratt, Mölnlycke (SE); Tobias Good, Mölnlycke (SE); Zachary Mark Smith, Greenwood Village, CO (US)

(73) Assignee: Cochlear Limited, Macquarie University, NSW (AU)

( * ) Notice: Subject to any disclaimer, the term of this patent is extended or adjusted under 35 U.S.C. 154(b) by 45 days.

This patent is subject to a terminal disclaimer.

(21) Appl. No.: 14/855,783

(22) Filed: Sep. 16, 2015

(65) Prior Publication Data

US 2016/0080878 A1 Mar. 17, 2016

Related U.S. Application Data

(60) Provisional application No. 62/051,768, filed on Sep. 17, 2014.

(51) Int. Cl.
*H04R 25/00* (2006.01)

(52) U.S. Cl.
CPC ..... *H04R 25/558* (2013.01); *H04R 25/606* (2013.01); *H04R 2460/13* (2013.01)

(58) Field of Classification Search
CPC ..... H04R 2460/13; H04R 2400/01; H04R 25/606
USPC ..... 381/151, 326, 163, 380
See application file for complete search history.

(56) References Cited

U.S. PATENT DOCUMENTS

| | | | | |
|---|---|---|---|---|
| 8,325,964 | B2 * | 12/2012 | Weisman | H04R 1/1083 381/151 |
| 8,965,012 | B1 | 2/2015 | Dong et al. | |
| 2003/0161492 | A1 * | 8/2003 | Miller | H04R 25/453 381/326 |
| 2012/0286765 | A1 | 11/2012 | Van den Heuvel et al. | |
| 2012/0300953 | A1 | 11/2012 | Mauch et al. | |
| 2012/0316454 | A1 | 12/2012 | Carter | |
| 2013/0018284 | A1 * | 1/2013 | Kahn | G04G 13/026 600/595 |
| 2014/0072148 | A1 * | 3/2014 | Smith | H04R 1/08 381/151 |
| 2014/0169597 | A1 | 6/2014 | Gartner | |
| 2014/0270230 | A1 * | 9/2014 | Oishi | H04R 1/1016 381/74 |
| 2014/0275729 | A1 * | 9/2014 | Hillbratt | H04R 25/552 600/25 |
| 2014/0286513 | A1 | 9/2014 | Hillbratt et al. | |
| 2015/0256949 | A1 | 9/2015 | Vanpoucke et al. | |
| 2016/0234613 | A1 * | 8/2016 | Westerkull | H04R 25/606 |

* cited by examiner

*Primary Examiner* — Suhan Ni
(74) *Attorney, Agent, or Firm* — Pilloff & Passino LLP; Martin J. Cosenza

(57) ABSTRACT

A device, including an actuator configured to evoke a hearing percept via actuation thereof, wherein the device is configured to make a detection of at least one phenomenon related to the actuator that is indicative of a recipient of the device speaking and control circuitry, wherein the control circuitry is configured to control an operation of the device based on the detection.

22 Claims, 20 Drawing Sheets

CONTROL TECHNIQUES BASED ON OWN VOICE RELATED PHENOMENA

CROSS-REFERENCE TO RELATED APPLICATIONS

This application claims priority to Provisional U.S. Patent Application No. 62/051,768, entitled CONTROL TECHNIQUES BASED ON OWN VOICE RELATED PHENOMENA, filed on Sep. 17, 2014, naming Martin Evert Gustaf HILLBRATT of Molnlycke, Sweden, as an inventor, the entire contents of that application being incorporated herein by reference in its entirety.

BACKGROUND

Hearing loss, which may be due to many different causes, is generally of two types: conductive and sensorineural. Sensorineural hearing loss is typically due to the absence or destruction of the hair cells in the cochlea that transduce sound signals into nerve impulses. Various hearing prostheses are commercially available to provide individuals suffering from sensorineural hearing loss with the ability to perceive sound.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the cochlea functions normally.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received at the outer ear of the recipient. This amplified sound reaches the cochlea causing motion of the perilymph and stimulation of the auditory nerve.

In contrast to hearing aids, which rely primarily on the principles of air conduction, certain types of hearing prostheses, commonly referred to as bone conduction devices, convert a received sound into vibrations. The vibrations are transferred through the skull to the cochlea causing generation of nerve impulses, which result in the perception of the received sound. In some instances, bone conduction devices can be used to treat single sided deafness, where the bone conduction device is attached to the mastoid bone on the contra lateral side of the head from the functioning "ear" and transmission of the vibrations is transferred through the skull bone to the functioning ear. Bone conduction devices can be used, in some instances, to address pure conductive losses (faults on the pathway from the outer ear towards the cochlea) or mixed hearing losses (faults on this pathway in combination with moderate sensorineural hearing).

SUMMARY

In accordance with one aspect, there is a device, comprising an actuator configured to evoke a hearing percept via actuation thereof, wherein the device is configured to make a detection of at least one phenomenon related to the actuator that is indicative of a recipient of the device speaking; and control circuitry, wherein the control circuitry is configured to control an operation of the device based on the detection.

In accordance with another aspect, there is a method, comprising receiving body tissue conducted vibrations originating from an own-voice speaking event of a recipient with an electro-mechanical component, comparing first data based on a signal of a system including the electro-mechanical component influenced by the received body tissue conducted vibrations with second data influenced by an own-voice speaking event, controlling a device based on the comparison.

In accordance with another aspect, there is a method, comprising receiving body tissue conducted vibrations originating from an own-voice speaking event with an electro-mechanical component implanted in a recipient, comparing first data based on a signal of a system including the electro-mechanical component influenced by the received body tissue conducted vibrations with second data influenced by an own-voice speaking event, and controlling a device based on the comparison.

In accordance with another aspect, there is a method of reducing effects of own-voice in a method of evoking a hearing percept with a hearing prosthesis, comprising evoking a first hearing percept utilizing an implanted actuator, utilizing the actuator as a microphone, and determining that an own-voice event has occurred based on the action of utilizing the actuator as a microphone.

BRIEF DESCRIPTION OF THE DRAWINGS

Some embodiments are described below with reference to the attached drawings, in which.

DETAILED DESCRIPTION

Some and/or all embodiments of the technologies detailed herein by way of example and not by way of limitation can have utilitarian value when applied to various hearing devices. Two exemplary hearing prostheses will first be described in the context of the human auditory system, followed by a description of some of the embodiments. That said, it is noted that in alternate embodiments, at least some of the teachings detailed herein can be utilized with prostheses and hearing devices different from hearing prostheses.

Figure 1A:
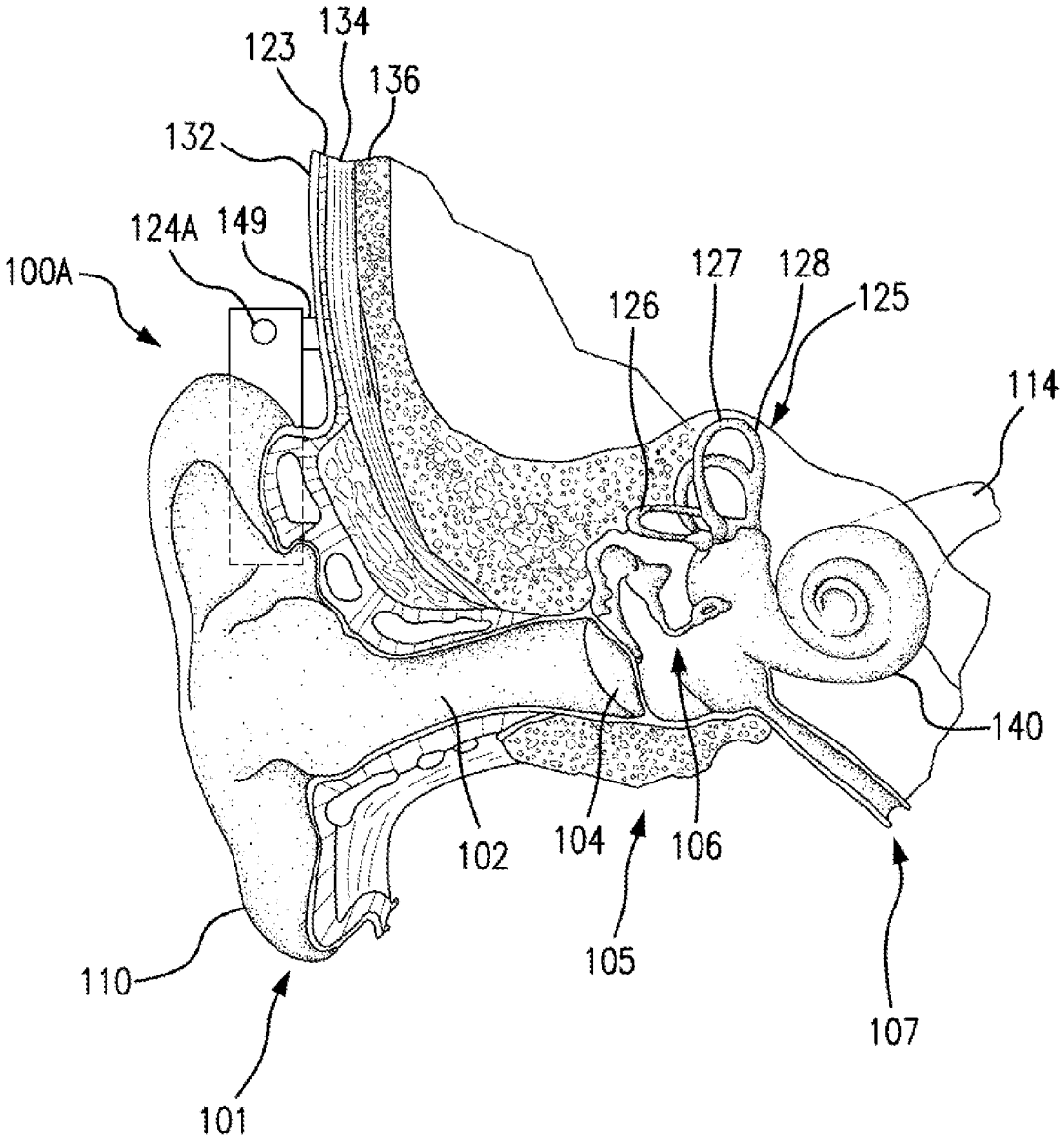
FIG. 1A is a perspective view of an exemplary bone conduction device in which at least some embodiments can be implemented.

FIG. 1A is a perspective view of a bone conduction device 100A in which embodiments may be implemented. As shown, the recipient has an outer ear 101 including ear canal 102, a middle ear 105 where the tympanic membrane 104 separates the two, and an inner ear 107. Some elements of outer ear 101, middle ear 105 and inner ear 107 are described below, followed by a description of bone conduction device 100.

FIG. 1A also illustrates the positioning of bone conduction device 100A relative to outer ear 101, middle ear 105 and inner ear 103 of a recipient of device 100. As shown, bone conduction device 100 is positioned behind outer ear 101 of the recipient and comprises a sound capture element 124A to receive sound signals. Sound capture element may comprise, for example, a microphone, accelerometer, telecoil, etc. Sound capture element 124A can be located, for example, on or in bone conduction device 100A, or on a cable extending from bone conduction device 100A.

Bone conduction device 100A can comprise an operationally removable component and a bone conduction implant. The operationally removable component is operationally releasably coupled to the bone conduction implant. By operationally releasably coupled, it is meant that it is releasable in such a manner that the recipient can relatively easily attach and remove the operationally removable component during normal use of the bone conduction device 100A. Such releasable coupling is accomplished via a coupling assembly of the operationally removable component and a corresponding mating apparatus of the bone conduction implant, as will be detailed below. This as contrasted with how the bone conduction implant is attached to the skull, as will also be detailed below. The operationally removable component includes a sound processor (not shown), a vibrating electromagnetic actuator and/or a vibrating piezoelectric actuator and/or a magnetostrictive actuator and/or other type of actuator (not shown—which are sometimes referred to herein as a species of the genus vibrator) and/or various other operational components, such as sound input device 124A. In this regard, the operationally removable component is sometimes referred to herein as a vibrator unit and/or an actuator. More particularly, sound input device 124A (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull.

As illustrated, the operationally removable component of the bone conduction device 100A further includes a coupling assembly 149 configured to operationally removably attach the operationally removable component to a bone conduction implant (also referred to as an anchor system and/or a fixation system) which is implanted in the recipient. With respect to FIG. 1A, coupling assembly 149 is coupled to the bone conduction implant (not shown) implanted in the recipient in a manner that is further detailed below with respect to exemplary bone conduction implants. Briefly, an exemplary bone conduction implant may include a percutaneous abutment attached to a bone fixture via a screw, the bone fixture being fixed to the recipient's skull bone 136. The abutment extends from the bone fixture which is screwed into bone 136, through muscle 134, fat 128 and skin 232 so that the coupling assembly may be attached thereto. Such a percutaneous abutment provides an attachment location for the coupling assembly that facilitates efficient transmission of mechanical force.

It is noted that while many of the details of the embodiments presented herein are described with respect to a percutaneous bone conduction device, some or all of the teachings disclosed herein may be utilized in transcutaneous bone conduction devices and/or other devices that utilize a vibrating actuator (e.g., an electromagnetic actuator). For example, embodiments include active transcutaneous bone conduction systems utilizing the actuators disclosed herein and variations thereof where at least one active component (e.g., the electromagnetic actuator) is implanted beneath the skin. Embodiments also include passive transcutaneous bone conduction systems utilizing the electromagnetic actuators disclosed herein and variations thereof where no active component (e.g., the electromagnetic actuator) is implanted beneath the skin (it is instead located in an external device), and the implantable part is, for instance, a magnetic pressure plate. Some embodiments of the passive transcutaneous bone conduction systems are configured for use where the vibrator (located in an external device) containing the electromagnetic actuator is held in place by pressing the vibrator against the skin of the recipient. In an exemplary embodiment, the vibrator is held against the skin via a magnetic coupling (magnetic material and/or magnets being implanted in the recipient and the vibrator having a magnet and/or magnetic material to complete the magnetic circuit, thereby coupling the vibrator to the recipient).

Figure 1B:
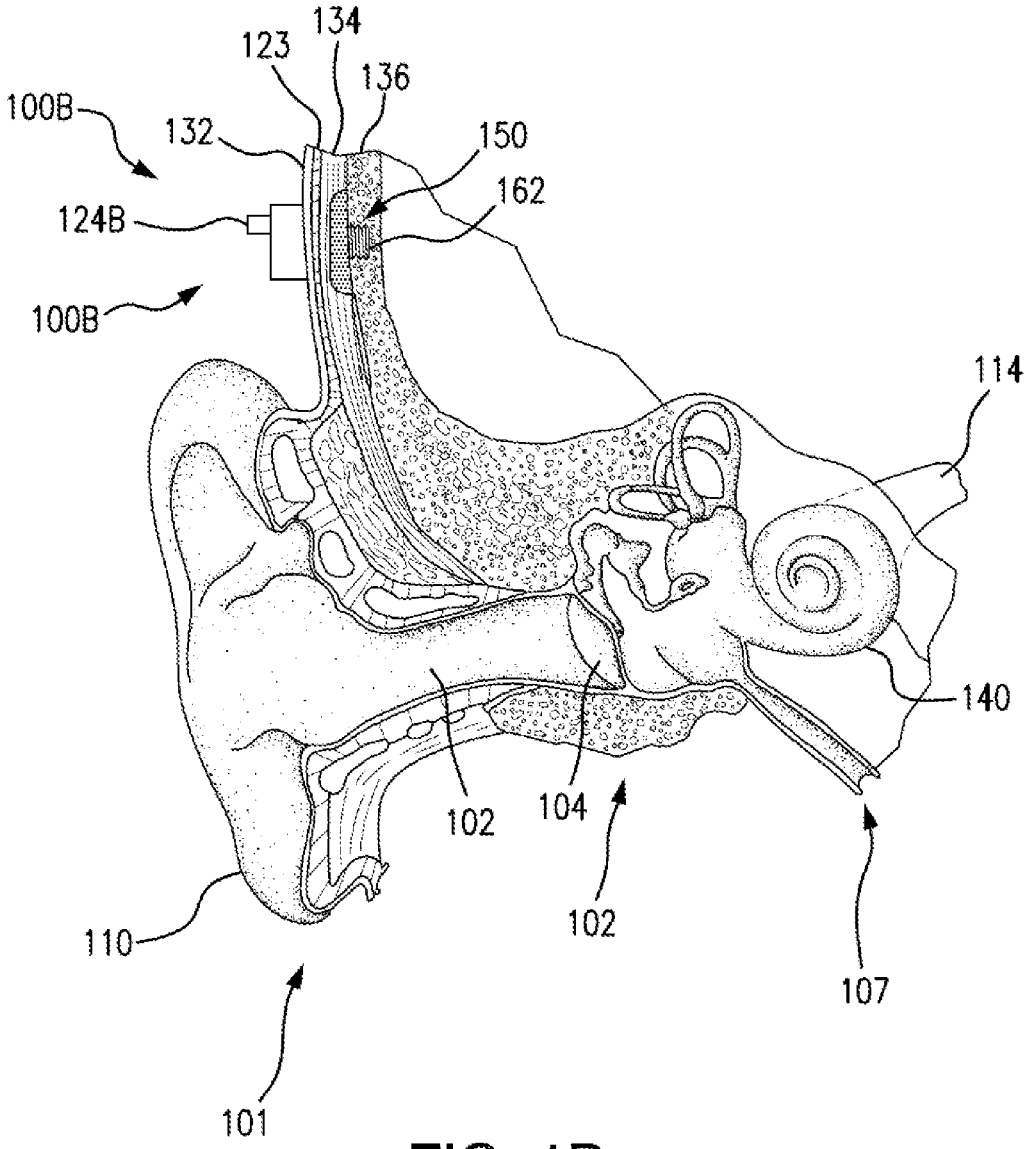
FIG. 1B is a perspective view of an alternate exemplary bone conduction device in which at least some embodiments can be implemented.

More specifically, FIG. 1B is a perspective view of a transcutaneous bone conduction device 100B in which embodiments can be implemented.

FIG. 1B also illustrates the positioning of bone conduction device 100B relative to outer ear 101, middle ear 105 and inner ear 107 of a recipient of device 100. As shown, bone conduction device 100 is positioned behind outer ear 101 of the recipient. Bone conduction device 100B comprises an external component 140B and implantable component 150. The bone conduction device 100B includes a sound capture element 124B to receive sound signals. As with sound capture element 124A, sound capture element 124B may comprise, for example, a microphone, telecoil, etc. Sound capture element 124B may be located, for example, on or in bone conduction device 100B, on a cable or tube extending from bone conduction device 100B, etc. Alternatively, sound capture element 124B may be subcutaneously implanted in the recipient, or positioned in the recipient's ear. Sound capture element 124B may also be a component that receives an electronic signal indicative of sound, such as, for example, from an external audio device. For example, sound capture element 124B may receive a sound signal in the form of an electrical signal from an MP3 player electronically connected to sound capture element 124B.

Bone conduction device 100B comprises a sound processor (not shown), an actuator (also not shown) and/or various other operational components. In operation, sound capture element 124B converts received sounds into electrical signals. These electrical signals are utilized by the sound processor to generate control signals that cause the actuator to vibrate. In other words, the actuator converts the electrical signals into mechanical vibrations for delivery to the recipient's skull.

A fixation system 162 may be used to secure implantable component 150 to skull 136. As described below, fixation system 162 may be a bone screw fixed to skull 136, and also attached to implantable component 150.

In one arrangement of FIG. 1B, bone conduction device 100B can be a passive transcutaneous bone conduction device. That is, no active components, such as the actuator, are implanted beneath the recipient's skin 132. In such an arrangement, the active actuator is located in external component 140B, and implantable component 150 includes a magnetic plate, as will be discussed in greater detail below. The magnetic plate of the implantable component 150 vibrates in response to vibration transmitted through the skin, mechanically and/or via a magnetic field, that are generated by an external magnetic plate.

In another arrangement of FIG. 1B, bone conduction device 100B can be an active transcutaneous bone conduction device where at least one active component, such as the actuator, is implanted beneath the recipient's skin 132 and is thus part of the implantable component 150. As described below, in such an arrangement, external component 140B may comprise a sound processor and transmitter, while implantable component 150 may comprise a signal receiver and/or various other electronic circuits/devices.

Figure 2A:
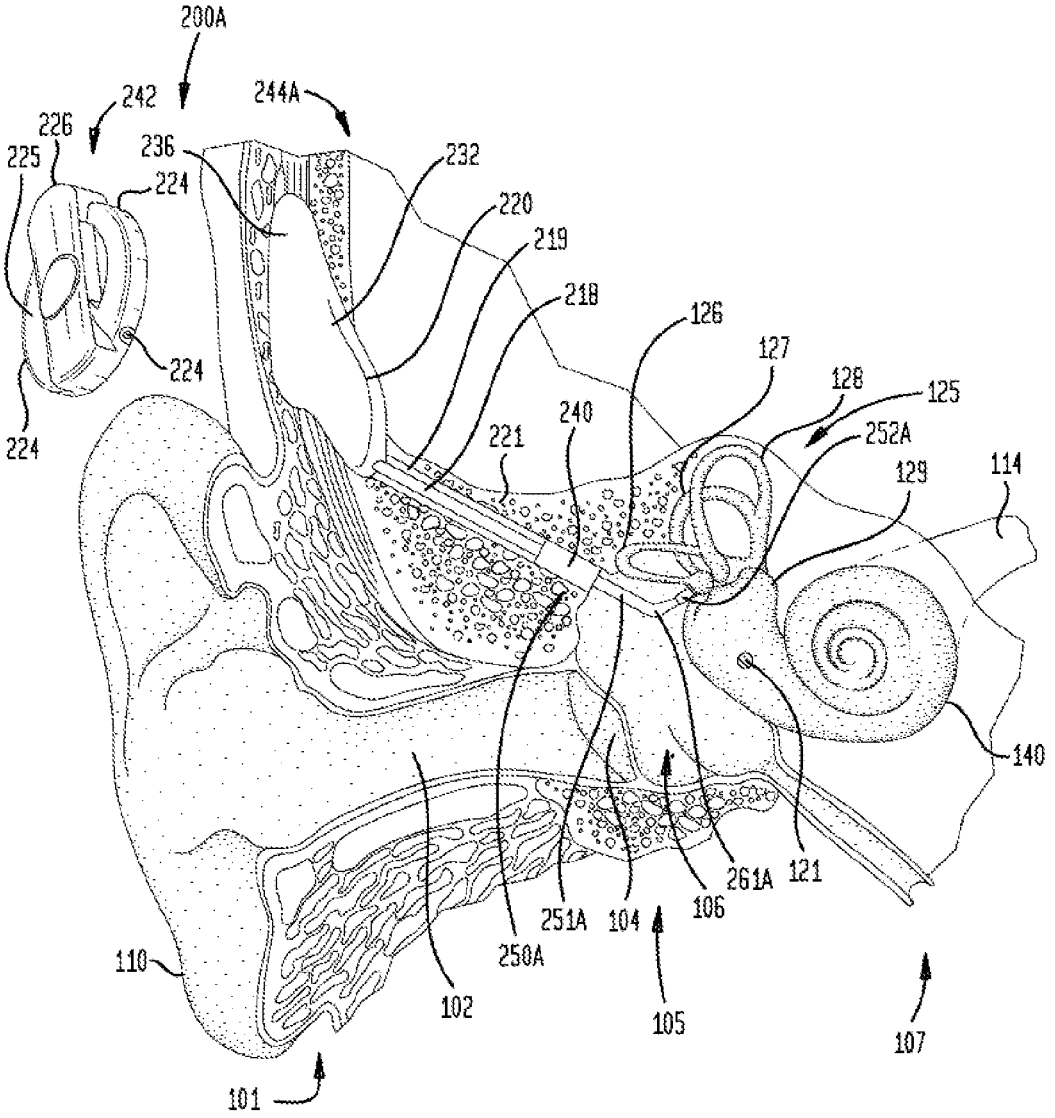
FIG. 2A is a perspective view of an exemplary direct acoustic cochlear implant (DACI) implanted in accordance with some exemplary embodiments.

FIG. 2A is a perspective view of an exemplary direct acoustic cochlear implant (DACI) 200A in accordance an exemplary embodiment. DACI 200A comprises an external component 242 that is directly or indirectly attached to the body of the recipient, and an internal component 244A that is temporarily or permanently implanted in the recipient. External component 242 typically comprises two or more sound capture elements, such as microphones 224, for detecting sound, a sound processing unit 226, a power source (not shown), and an external transmitter unit 225. External transmitter unit 225 comprises an external coil (not shown). Sound processing unit 226 processes the output of microphones 224 and generates encoded data signals which are provided to external transmitter unit 225. For ease of illustration, sound processing unit 226 is shown detached from the recipient.

Internal component 244A comprises an internal receiver unit 232, a stimulator unit 220, and a stimulation arrangement 250A in electrical communication with stimulator unit 220 via cable 218 extending thorough artificial passageway 219 in mastoid bone 221. Internal receiver unit 232 and stimulator unit 220 are hermetically sealed within a biocompatible housing, and are sometimes collectively referred to as a stimulator/receiver unit.

In the illustrative embodiment of FIG. 2A, ossicles 106 have been explanted. However, it should be appreciated that stimulation arrangement 250A may be implanted without disturbing ossicles 106.

Stimulation arrangement 250A comprises an actuator 240, a stapes prosthesis 252A and a coupling element 251A which includes an artificial incus 261B. Actuator 240 is osseointegrated to mastoid bone 221, or more particularly, to the interior of artificial passageway 219 formed in mastoid bone 221.

In this embodiment, stimulation arrangement 250A is implanted and/or configured such that a portion of stapes prosthesis 252A abuts an opening in one of the semicircular canals 125. For example, in the illustrative embodiment, stapes prosthesis 252A abuts an opening in horizontal semicircular canal 126. In alternative embodiments, stimulation arrangement 250A is implanted such that stapes prosthesis 252A abuts an opening in posterior semicircular canal 127 or superior semicircular canal 128.

As noted above, a sound signal is received by microphone(s) 224, processed by sound processing unit 226, and transmitted as encoded data signals to internal receiver 232. Based on these received signals, stimulator unit 220 generates drive signals which cause actuation of actuator 240. The mechanical motion of actuator 240 is transferred to stapes prosthesis 252A such that a wave of fluid motion is generated in horizontal semicircular canal 126. Because, vestibule 129 provides fluid communication between the semicircular canals 125 and the median canal, the wave of fluid motion continues into median canal, thereby activating the hair cells of the organ of Corti. Activation of the hair cells causes appropriate nerve impulses to be generated and transferred through the spiral ganglion cells (not shown) and auditory nerve 114 to cause a hearing percept in the brain.

Figure 2B:
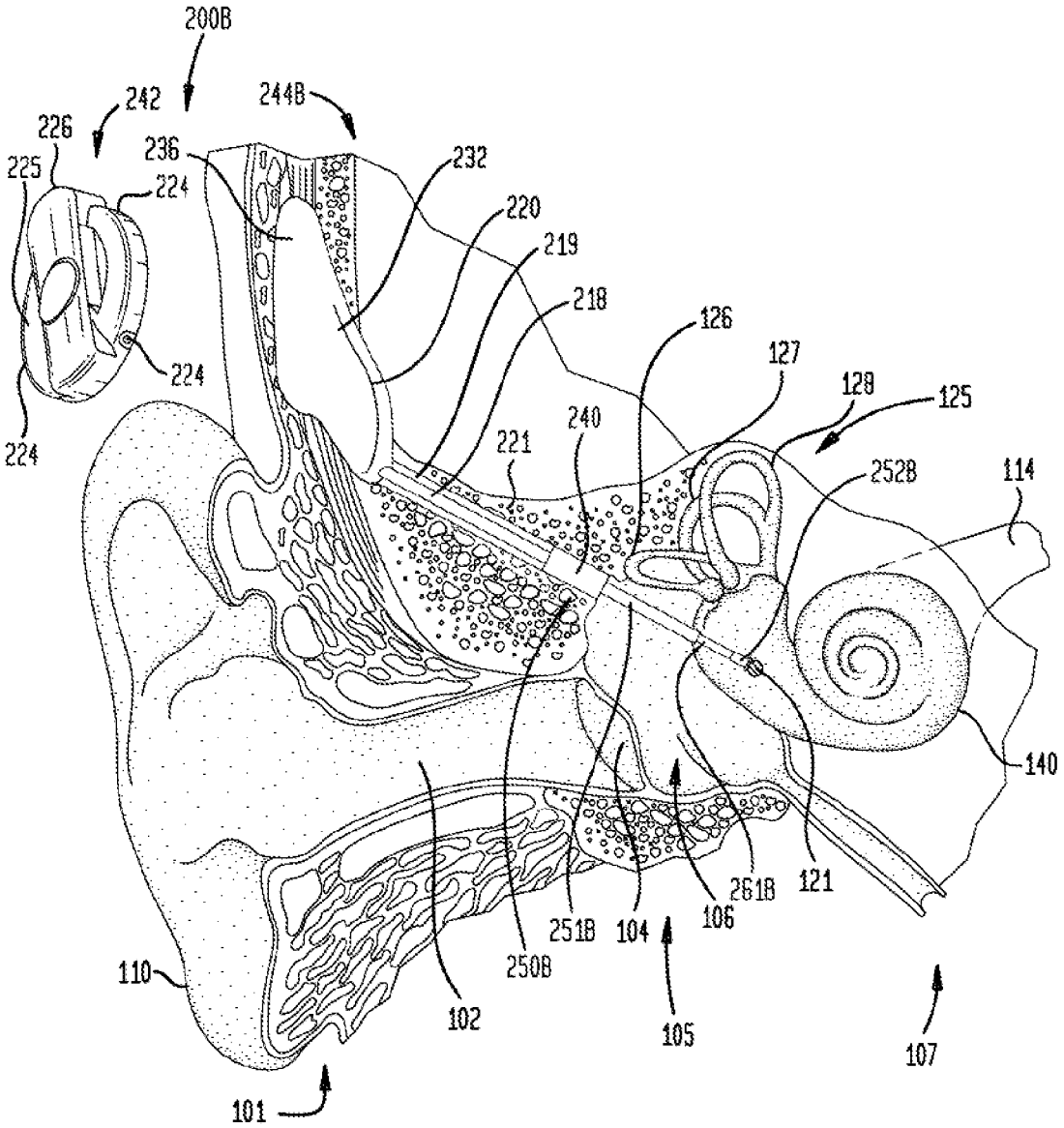
FIG. 2B is a perspective view of an exemplary DACI implanted in accordance with an exemplary embodiment.

FIG. 2B is a perspective view of another type of DACI 200B in accordance with an exemplary embodiment. DACI 200B comprises external component 242 and an internal component 244B.

Stimulation arrangement 250B comprises actuator 240, a stapes prosthesis 252B and a coupling element 251B which includes artificial incus 261B which couples the actuator to the stapes prosthesis. In this embodiment, stimulation arrangement 250B is implanted and/or configured such that a portion of stapes prosthesis 252B abuts round window 121 of cochlea 140.

Figure 2C:
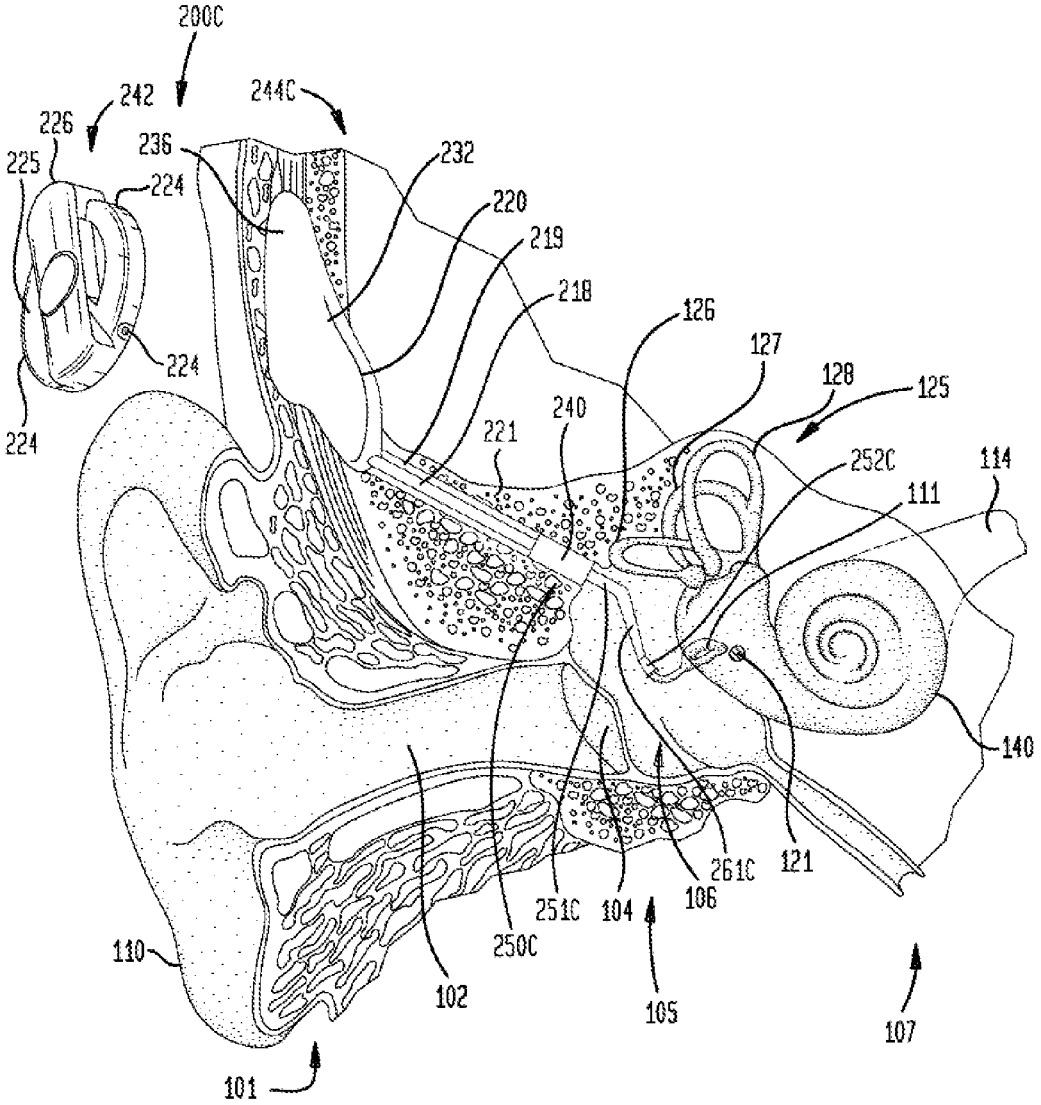
FIG. 2C is a perspective view of an exemplary DACI implanted in accordance with an exemplary embodiment.

The embodiments of FIGS. 2A and 2B are exemplary embodiments of a middle ear implant that provides mechanical stimulation directly to cochlea 140. Other types of middle ear implants provide mechanical stimulation to middle ear 105. For example, middle ear implants may provide mechanical stimulation to a bone of ossicles 106, such to incus 109 or stapes 111. FIG. 2C depicts an exemplary embodiment of a middle ear implant 200C having a stimulation arrangement 250C comprising actuator 240 and a coupling element 251C. Coupling element 251C includes a stapes prosthesis 252C and an artificial incus 261C which couples the actuator to the stapes prosthesis. In this embodiment, stapes prosthesis 252C abuts stapes 111.

The bone conduction devices 100A and 100B include a component that moves in a reciprocating manner to evoke a hearing percept. The DACIs, 200B and 200C also include a component that moves in a reciprocating manner to evoke a hearing percept. The movement of these components results in the creation of vibrational energy where at least a portion of which is ultimately transmitted to the sound capture element(s) of the hearing prosthesis. In the case of the active transcutaneous bone conduction device 100B and DACIs 200A, 200B, 200C, in at least some scenarios of use, all or at least a significant amount of the vibrational energy transmitted to the sound capture device from the aforementioned component is conducted via the skin, muscle and fat of the recipient to reach the operationally removable component/external component and then to the sound capture element(s). In the case of the bone conduction device 100A and the passive transcutaneous bone conduction device 100B, in at least some scenarios of use, all or at least a significant amount of the vibrational energy that is transmitted to the sound capture device is conducted via the unit (the operationally removable component/the external component) that contains or otherwise supports the component that moves in a reciprocating manner to the sound capture element(s) (e.g., because that unit also contains or otherwise supports the sound capture element(s)). In some embodiments of these hearing prostheses, other transmission routs exist (e.g., through the air, etc.) and the transmission route can be a combination thereof. Regardless of the transmission route, energy originating from operational movement of the hearing prostheses to evoke a hearing percept that impinges upon the sound capture device, such that the output of the sound capture device is influenced by the energy, is referred to herein as physical feedback.

Figure 3:
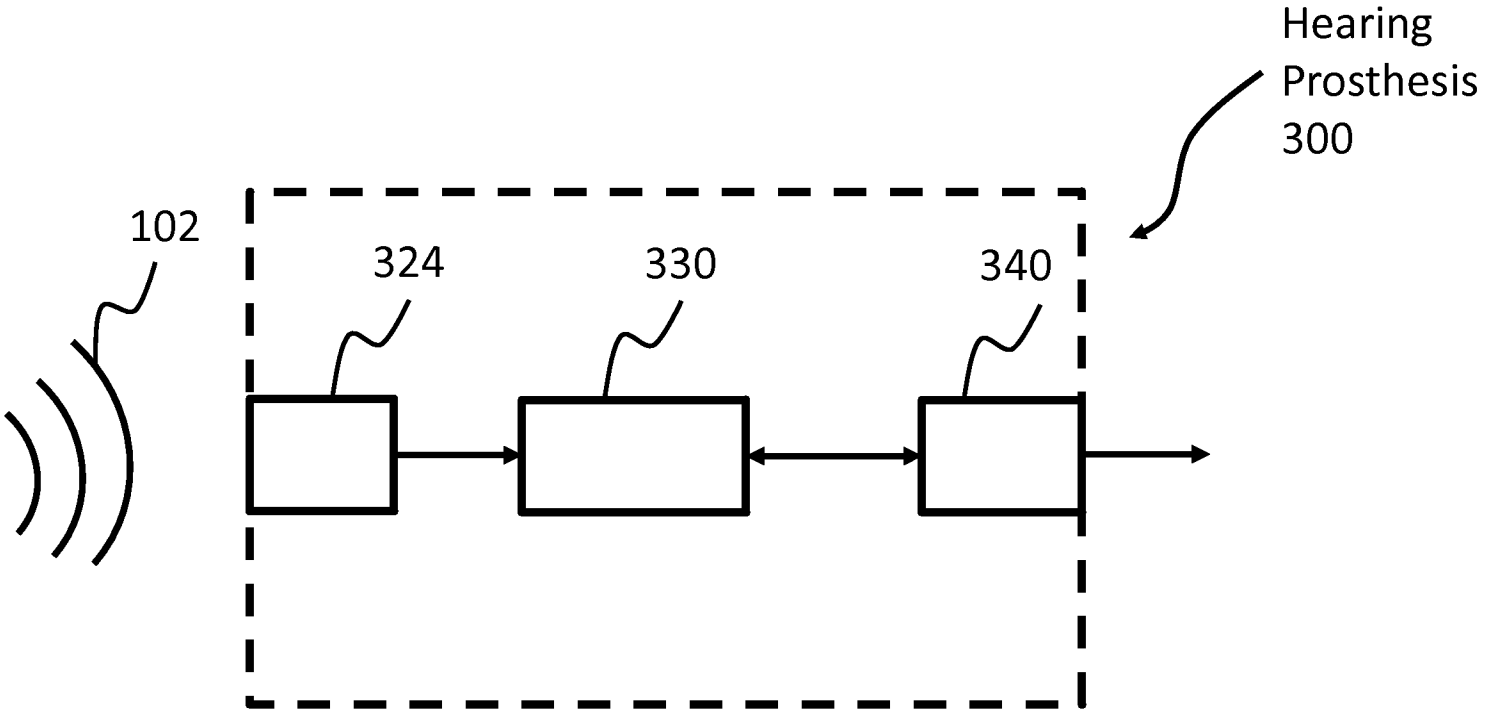
FIG. 3 is a functional diagram of an exemplary hearing prosthesis.

FIG. 3 depicts a functional diagram of an exemplary device 300. Examples of the device 300 will be described in terms of an exemplary embodiment where the device is a prosthesis. Specifically, a hearing prosthesis. The exemplary hearing prosthesis can correspond to any of those detailed above or other types of hearing prostheses (e.g., percutaneous bone conduction devices, active and/or passive transcutaneous bone conduction devices, dental implants bone conduction devices, direct acoustic cochlear implants/middle ear implants, etc.). That said, alternate exemplary embodiments can be implemented in a non-prosthetic device. Any device that can enable the teachings detailed herein and/or variations thereof to be implemented can be utilized in at least some embodiments.

With reference to the device 300 as a hearing prosthesis, the hearing prosthesis 300 includes a sound capture device 324 which, in an exemplary embodiment, is a microphone, and corresponds to sound capture element 124 detailed above. The hearing prosthesis 300 further includes a processing section 330, which receives the output signal from the microphone 324, and utilizes the output to develop a control signal outputted to transducer 340, which, in an exemplary embodiment, corresponds to electro-mechanical actuator such as the actuators utilized with the hearing prostheses detailed above.

In broad conceptual terms, the above hearing prostheses and other types of hearing prostheses (e.g., conventional hearing aids, which the teachings herein and/or variations thereof are also applicable), operate on the principle illustrated in FIG. 3. Specifically, sound 102 is captured via microphone 324 and is transduced into an electrical signal that is delivered to processing section 330. Processing section 330 includes various elements and performs various functions. However, in the broadest sense, the processing section 330 includes a filter section, which, in at least some embodiments, includes a series of filters, and an amplifier section, which amplifies the output of the processing section. Processing section 330 can divide the signal received from microphone 324 into various frequency components and processes the different frequency components in different manners. In an exemplary embodiment, some frequency components are amplified more than other frequency components. The output of processing section 330 is one or more signals that are delivered to transducer 340, which converts the output to mechanical energy (or, in the case of a conventional hearing aid, acoustic energy) that evokes a hearing percept.

Elements 324, 330, and 340, are depicted within a box illustrated with a dashed line to indicate that the elements of the hearing prosthesis 300 can be bifurcated and/or trifurcated, etc., into separate components in signal communication with one another. In this regard, in an exemplary embodiment where all of the elements are located in a single housing, such can correspond to a totally implantable hearing prostheses or a completely external hearing prostheses (e.g., such as that of FIG. 1A above). In an exemplary embodiment where, for example, microphone 324 and processing section 330 are part of an external component of the hearing prostheses 300, and, for example, actuator 340 is part of an implantable component, microphone 324 and processing section 330 can be located in and/or on a single housing, and actuator 340 can be located in another housing witches implantable (such as the embodiment of FIG. 1B above with respect to the active transcutaneous bone conduction device and the embodiments of FIGS. 2A-2C).

Figure 4A:
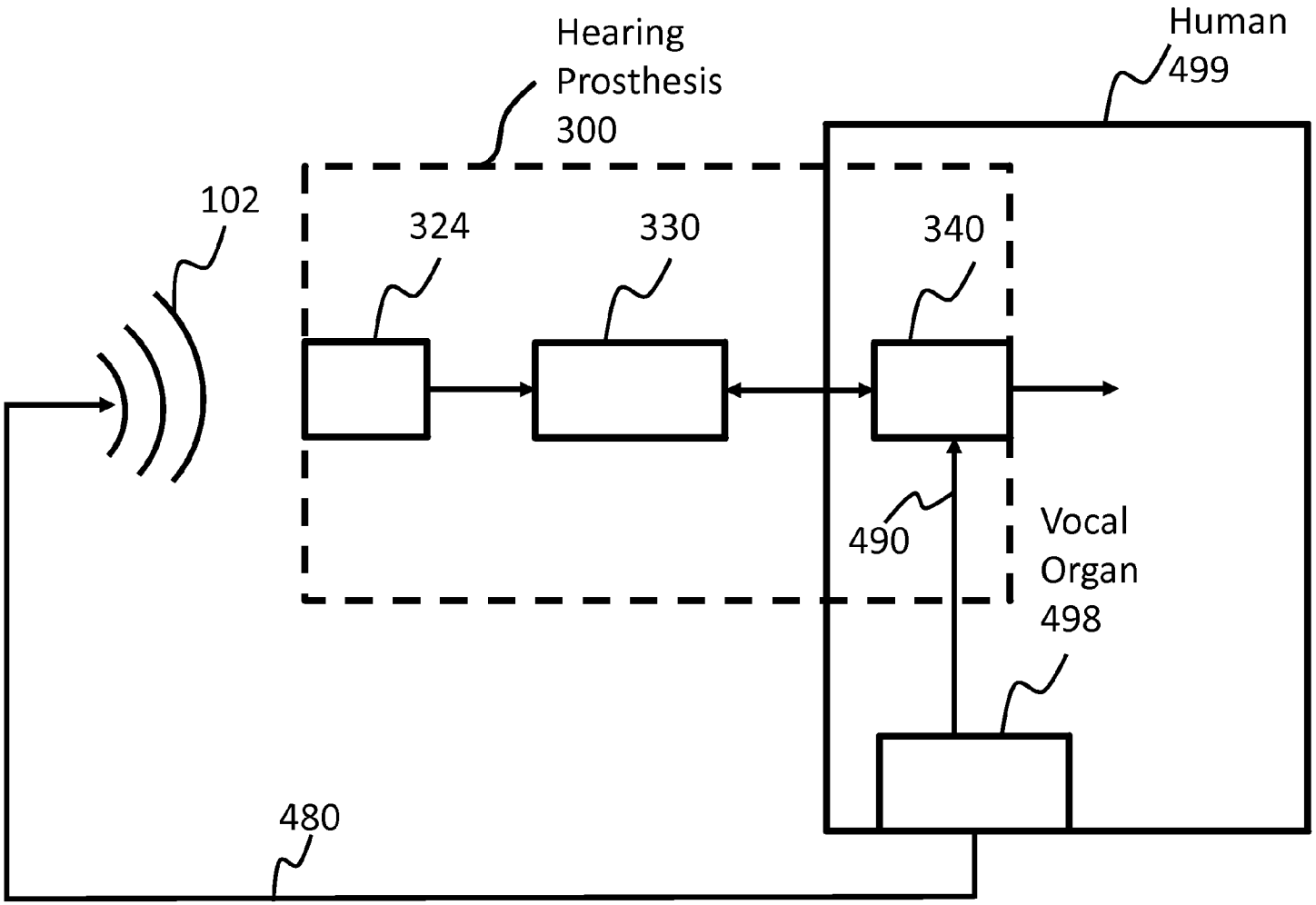
FIG. 4A is a functional diagram of a human recipient interacting with the prosthesis of FIG. 3.

FIG. 4A depicts a functional diagram of the hearing prostheses 300 interacting with a human 499, all components being depicted in black box format. In the embodiment of FIG. 4A, the hearing prosthesis 300 is a partially implantable hearing prosthesis corresponding to the embodiment of FIG. 1B above with respect to the active transcutaneous bone conduction device in the embodiments of FIGS. 2A-2C). FIG. 4A depicts a signal path 480 which corresponds to airborne pressure waves emanating from vocal organ 498 of the human 499 as a result of the human 499 vocalizing (e.g., talking). As can be seen, signal path 480 results in the sound 102 which is captured by the microphone 324. Accordingly, the hearing prostheses 300 according to FIG. 4A would evoke a hearing percept via actuation of actuator 340 based upon the captured sound 102 corresponding to the recipient's own voice traveling through the air to the microphone 324.

Also as can be seen from FIG. 4A, there is a signal path 490 which corresponds to a bone conducted vibration emanating from the vocal organ 498 of the human 499 as a result of the human 499 vocalizing. Signal path 490 leads to actuator 340. (It is noted that while not shown, there are additional signal paths leading from vocal organ 498 to other locations in the human 499, such as by way of example only and not by way of limitation, the cochlea of the human 499 in a manner corresponding to the phenomenon which enables a human to hear himself or herself speaking while the human covers his or her ears.)

Signal path 490 results in vibrational energy being received by the transducer 340. This vibrational energy results in the occurrence of one or more phenomenon associated with the transducer 340. In an exemplary embodiment, where the transducer 340 is an electro-mechanical actuator, the vibrational energy can result in the voltage across the actuator (e.g., the voltage across an electromagnetic actuation component of the actuator) being different from that which would otherwise be the case if the transducer 340 was vibrationally isolated from the vibrations resulting from signal path 490. In an exemplary embodiment, the vibrational energy can result in movement of the components of the transducer 340 such that the transducer 340 outputs an electrical signal to the processing section 330.

Additional details of results of the signal path 490 affecting a phenomenon associated with the transducer 340 will be described below, where transducer 340 is an actuator. Later, alternate embodiments where transducer 340 is an accelerometer and/or functions as an accelerometer will be described. First, however, alternate embodiments of hearing prostheses 300 and their interaction with humans will be briefly described.

Figure 4B:
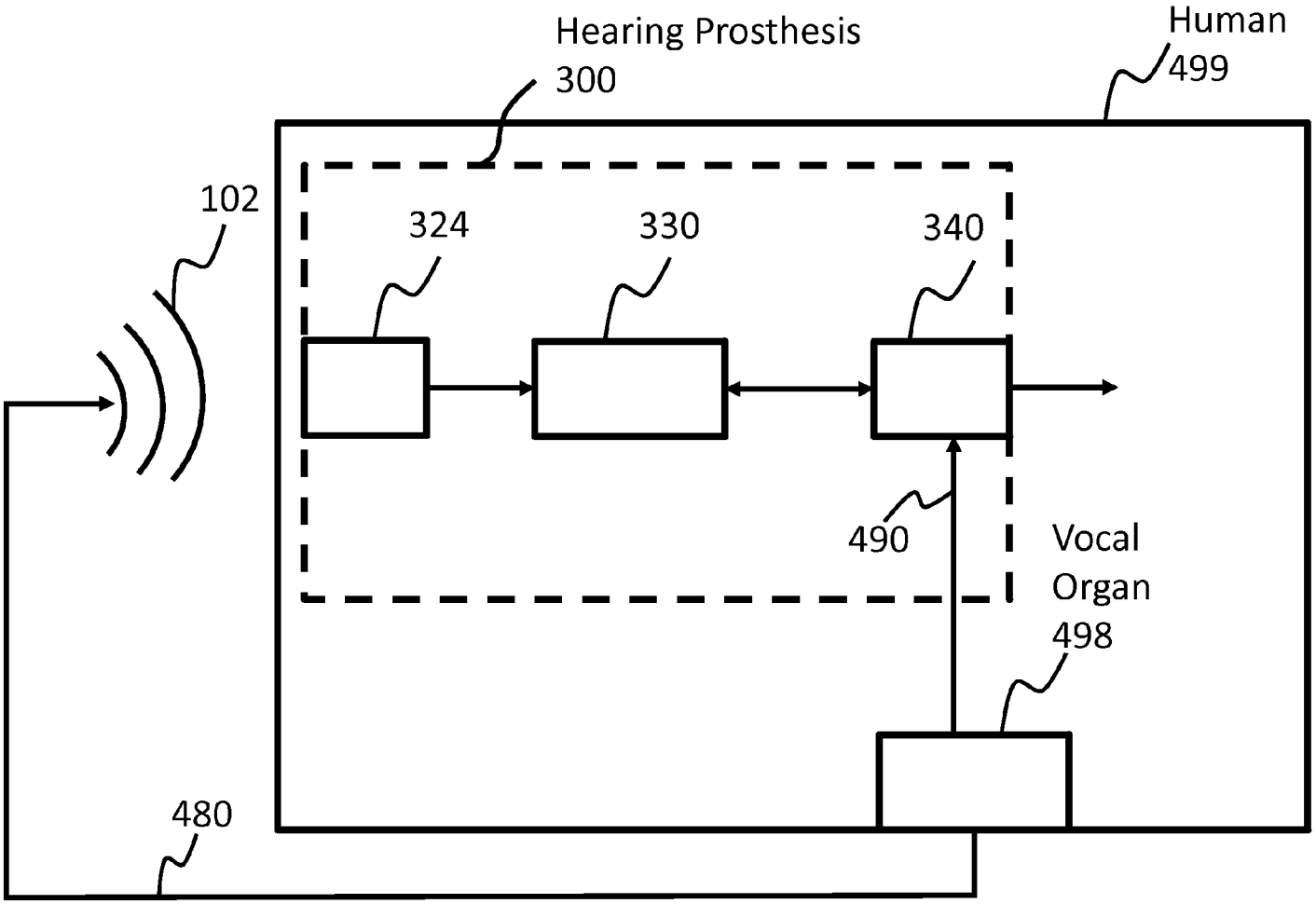
FIG. 4B is another functional diagram of a human recipient interacting with the prosthesis of FIG. 3.

FIG. 4B depicts a functional diagram of a totally implantable hearing prostheses 300 interacting with a human 499. FIG. 4B depicts a signal path 480 which corresponds to airborne pressure waves emanating from vocal organ 498 of the human 499 as a result of the human 499 vocalizing (e.g., talking). As can be seen, signal path 480 results in the sound 102 which is captured by the microphone 324, albeit after impinging upon the skin of the recipient and travelling therethrough to the implanted microphone 324. Signal path 490 corresponds to that of FIG. 4A detailed above.

Figure 4C:
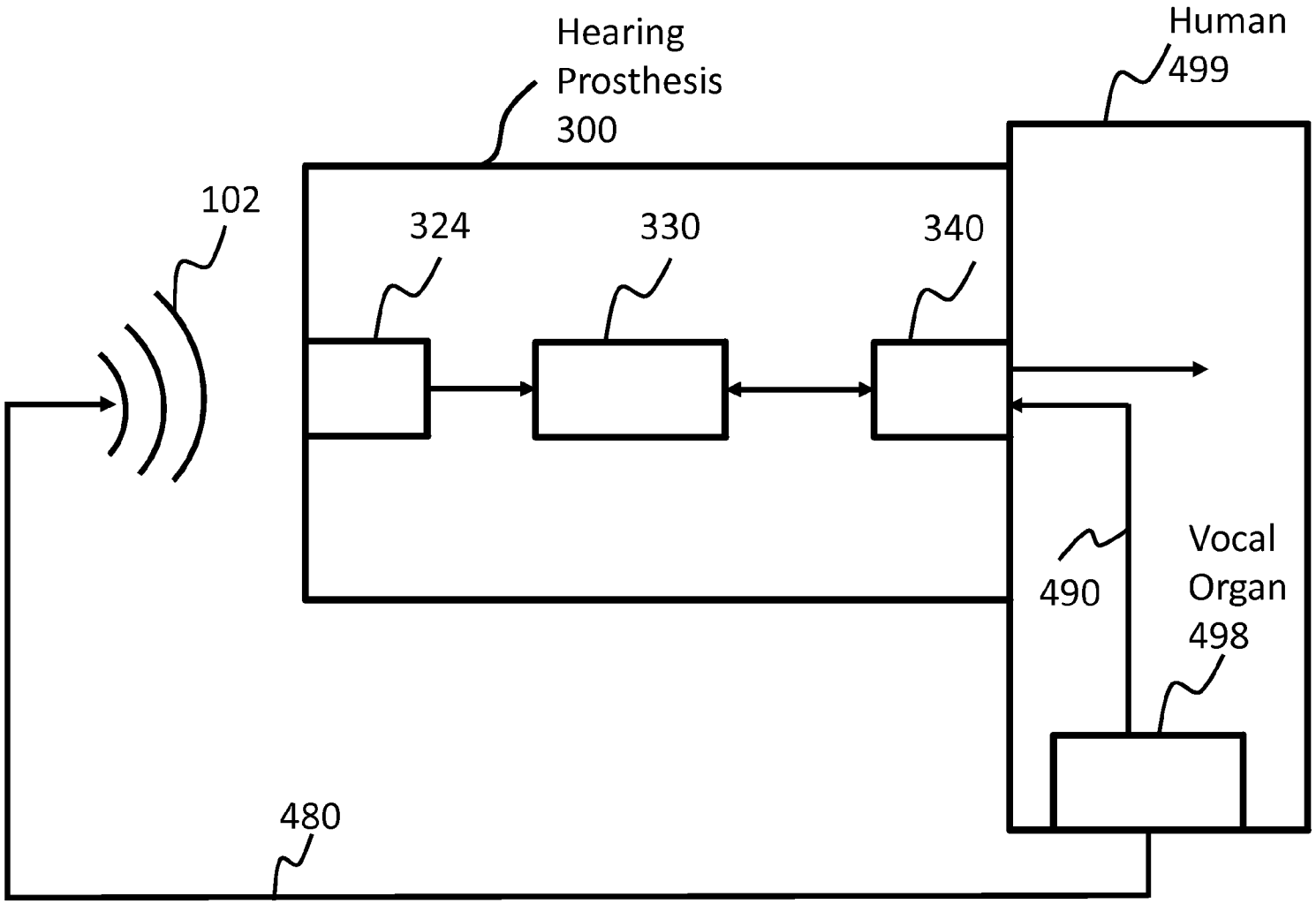
FIG. 4C is another functional diagram of a human recipient interacting with the prosthesis of FIG. 3.

FIG. 4C depicts a functional diagram of a hearing prostheses 300 which is completely external, or where the microphone 324, the processing section 330 and the actuator 340 are external, interacting with a human 499. FIG. 4C functionally corresponds to the passive transcutaneous bone conduction device of FIG. 1B and, in some embodiments, to the percutaneous bone conduction device of FIG. 1A. FIG. 4C depicts signal path 490 extending from the vocal organ 498 to the actuator 340 located in external to the recipient.

In each of the embodiments of FIGS. 4A-4C, vibrations emanating from the vocal organ 498 via path 490 that are received by the actuator 340 results in a phenomenon related to that actuator changing and/or coming into existence. That is, there is a phenomenon associated with the actuator that is different and/or exists due to the fact that bone conducted vibrations resulting from the vocalization of the recipient of the prosthesis are being received by the actuator 340 (as compared to a scenario where the actuator was completely vibrationally isolated from the bone conducted vibrations).

In an exemplary embodiment, there is a device comprising a hearing prosthesis 300, including an actuator 340 configured to evoke a hearing percept via actuation thereof.

The device 300 is configured to make a detection of at least one phenomenon related to the actuator 340 that is indicative of a recipient of the device (e.g., the hearing prosthesis) speaking and controlling an operation of the device 300 based on the detection. In an exemplary embodiment, the device is configured to evaluate at least one phenomenon related to the actuator 340 and control an operation of the device 300 based on an evaluation that the least one phenomenon is indicative of a recipient of the device speaking. In an exemplary embodiment, the device includes control circuitry configured to control the operation of the device 300 based on the aforementioned detection.

In an exemplary embodiment, the phenomenon is an electrical phenomenon that results from the actuator 340 receiving bone conducted vibrations from the vocal organ 498. By way of example only and not by way of limitation, the phenomenon is a voltage of a system of which the actuator is a part. That said, in alternate embodiments, other electrical phenomenon can be utilized, such as by way of example only and not by way of limitation, current, resistance, voltage and/or inductance. Any other electrical phenomenon can be utilized in at least some embodiments providing that the teachings detailed herein and or variations thereof can be practiced. Indeed, other phenomena other than electrical phenomena can be utilized (e.g., the vibrational state of the actuator) providing that the teachings detailed herein and/or variations thereof can be practiced.

In an exemplary embodiment, the device 300 is a hearing prosthesis that is configured to monitor (e.g., includes electronic circuitry to monitor) an electrical characteristic (e.g., voltage, impedance, current, etc.) across the actuator 300, corresponding to a phenomenon related to the actuator. For example, the actuator can have an electrical input terminal and an electrical output terminal. The electrical characteristics at the input and/or output terminals can be monitored by the hearing prosthesis 300 or other components of the device of which the hearing prosthesis 300 is a part. When the recipient is not speaking, bone conducted vibrations originating from the vocal organs as a result of speech are not generated and thus such vibrations do not impact the phenomenon of the actuator 340. Accordingly, an actuation signal from processor section 330 will result in the electrical characteristics at the input terminal and/or the output terminal of the actuator to correspond to that which was outputted by the processor section 330. Conversely, when vibrations resulting from own voice body tissue conduction (e.g., bone conduction) reach the actuator, these vibrations will induce movement in the moving component of the actuator (e.g., the armature of an electromagnetic actuator). In a scenario where no signal is outputted by the processor section 330 to the actuator, the movement of the moving component will result in the generation of a current by the actuator, and thus current at the terminals (whereas otherwise, there would be no current at the terminals because processor section 330 is not outputting any signal to the actuator 340). In a scenario where a signal is outputted by the processor section 330 to the actuator, and where body tissue conducted vibrations resulting from the recipient's own voice reach the actuator, the performance of the actuator would be different than it otherwise would have been in the absence of such vibrations reaching the actuator. Thus, for example, the voltage across the actuator (e.g., across the terminals) would be different from that which would be the case in the absence of the vibrations reaching the actuator. This difference, and the aforementioned presence of the current at the terminals being respective phenomena related to the actuator that is indicative of a recipient of the hearing prosthesis speaking, because otherwise, there would be no difference/there would be no current, were the recipient not speaking, and thus the vocal organ not generating vibrations that are body tissue conducted to the actuator.

According, in an exemplary embodiment, the actuator 340 is configured to actuate in response to an electrical signal sent thereto along an electrical signal path leading to the actuator, wherein the phenomenon is an electrical phenomenon of the signal path.

Figure 5:
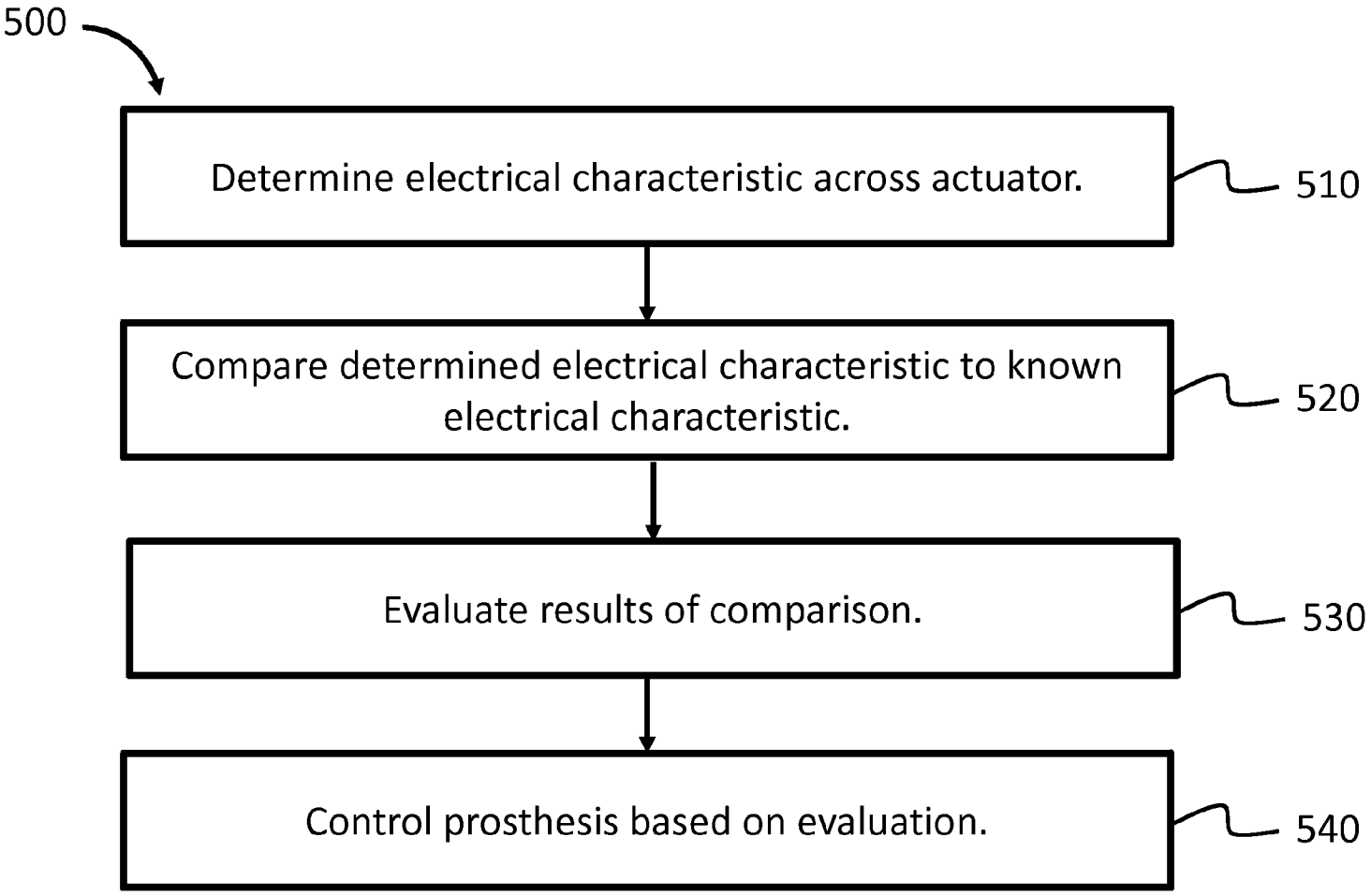
FIG. 5 is a flowchart for an exemplary method according to an exemplary embodiment.

In view of the above, FIG. 5 presents a flowchart for an exemplary method 500, which includes method action 510, entailing determining an electrical characteristic across the actuator 340. (An exemplary apparatus for and method of determining such is described below.) Method 500 includes method action 520, which entails comparing the determined electrical characteristic to a known electrical characteristic. In an exemplary embodiment, this can entail subtracting a value that represents the determined electrical characteristic determined at method action 510 from a known value that represents the electrical characteristic that should be across the actuator 340, at least in the absence of tissue conducted vibrations originating from the vocal organs impinging upon the actuator 340. In an alternate exemplary embodiment, this can entail dividing a value that represents the determined electrical characteristic determined at method action 510 by a known value that represents the electrical characteristic that should be across the actuator 340. In an exemplary embodiment, the electrical characteristic that should be across the actuator 340 corresponds to an output of the processing section 330, such as, by way of example and not by way of limitation, a control voltage outputted by the processing section 330. Still with reference to FIG. 5, method 500 includes method action 530, which entails evaluating the results of the comparison. This evaluation can entail determining whether the results of the subtraction and/or division are over and/or under a certain value (which can be a function based on various features, such as frequency content upon which the control signal outputted by the processing section 330 is based, etc.) and/or fall within and/or outside certain ranges, where the certain values and/or certain ranges are identified as values and/or ranges that are indicative of the actuator receiving vibrations resulting from a body tissue conducted own voice event and/or certain values and/or certain ranges are identified as values and/or ranges that are indicative of the actuator not receiving vibrations resulting from a body tissue conducted own voice event.

Based on the evaluation in method action 530, method 500 entails controlling the prosthesis (method action 540). If the evaluation of method action 530 results in data indicative of the actuator receiving vibrations resulting from a body tissue conducted own voice event, the prosthesis can be controlled in a certain manner (some examples of which are detailed below). If the evaluation of method action 530 results in data indicative of the actuator not receiving vibrations resulting from the body tissue conducted own voice event, the prosthesis can be controlled in another manner (typically, in a manner corresponding to "normal" operation of the hearing prosthesis, but with some exceptions, some of which are detailed below).

In view of the above, it can be seen that in an exemplary embodiment, the body tissue conduction (e.g. bone conduction) vibrations resulting from an own voice event can be utilized as a gate or trigger to determine which temporal segments of an outputted microphone signal correspond to "self-produced speech."

Figure 6:
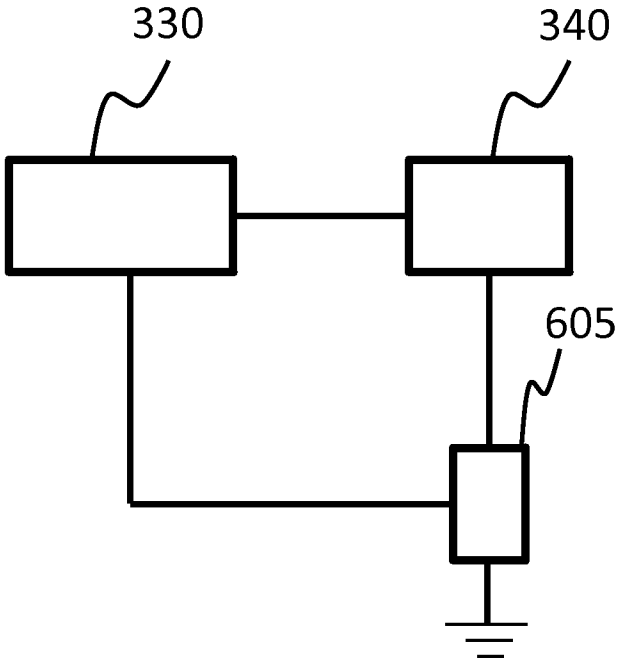
FIG. 6 is an exemplary circuit according to an exemplary embodiment.

FIG. 6 is a simplified block diagram of an exemplary system that can enable acquisition of one or more phenomenon related to the actuator 340. FIG. 6 depicts a shunt resistor 605 that is electrically connected in series to actuator 340, and can be used to measure features related to impedance across actuator 340 (e.g., a change of impedance across the actuator 340). In at least some embodiments, vibrations travelling from the vocal organ 498 to the actuator 340 via body tissue conduction due to an own voice event can result in a change in the mechanical impedance of the actuator 340 resulting from vibrations, which can result in a corresponding change of electrical impedance across the actuator.

Shunt resistor 605, also known as an ammeter shunt, can be a low resistance precision resistor used to measure AC or DC electric currents. However, a shunt resistor can include various other types of resistive elements, instead of or in addition to a typical, stand-alone shunt resistor, used to represent such a low resistance path, such as electrostatic discharge (ESD) components. It is noted that the utilization of the shunt resistor is but an example of one way to ascertain one or more phenomenon related to the actuator. Any device, system or method that can enable the detection or otherwise ascertation of the phenomenon related to the actuator 340 to enable the teachings detailed herein can be utilized at least some embodiments.

In an exemplary embodiment of method action 510, stimuli of known voltage is sent to actuator 340. More specifically, processor section 330 sends a signal (stimuli) to actuator 340, having a known voltage. The voltage across shunt resistor 605 is measured. As shown, for example, in FIG. 6, shunt resistor 605 is connected on one side to actuator 340 and thus processing section 330, and on the other side to ground. Therefore, processing section 330 can measure the voltage across shunt resistor 605 because it is connected to shunt resistor 605 opposite to ground.

Method action 520 can be executed by comparing the information from the shunt resistor 605 to the original stimuli sent to the actuator 340 (e.g., subtracting one from the other, dividing one by the other, etc.). Specifically, a difference in impedance across actuator 505 can be determined.

Figure 7:
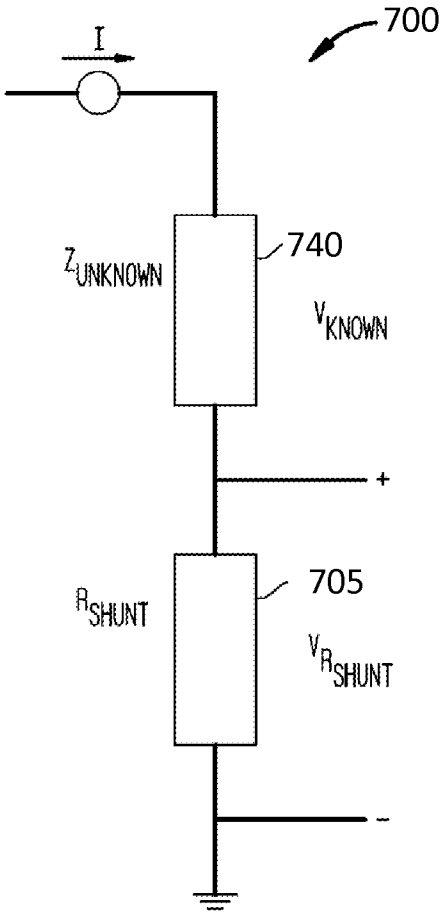
FIG. 7 is another exemplary circuit according to an exemplary embodiment.

It is noted that method action 520 can be executed by both determining a change in the voltage across the shunt resistor 605, as well as measuring the actual values of voltage across shunt resistor 605 to actually calculate the current and subsequently a change in electrical impedance of actuator 340. FIG. 7 shows a partial circuit diagram, a voltage divider, representative of the actuator 340 and shunt resistor 705 relationship described above with respect to FIG. 6. Circuit diagram 700 includes $Z_{unknown}$ 740, which represents the complex electrical impedance of actuator 340, and $R_{shunt}$ 705, which represents the resistance of shunt resistor 605. Furthermore, $V_{known}$, shown next to $Z_{unknown}$ 740 in FIG. 7, is the known voltage applied to actuator 340. $Z_{unknown}$ 740 is known because it is equal to the voltage stimulus applied to actuator 340 by processing section 330, as described above. $V_{Rshunt}$ represents a voltage, or a change in voltage, across $R_{shunt}$. Because the change in voltage across $R_{shunt}$ is proportional to the current through $R_{shunt}$, and therefore the current through actuator 340, the following equation may be used to determine $Z_{unknown}$:

$$Z_{unknown}=(R_{shunt}*V_{known})/V_{Rshunt}$$

Since $R_{shunt}*V_{known}$ are known and $V_{Rshunt}$ is calculated, as described, $Z_{unknown}$ may be calculated.

Accordingly, an exemplary embodiment includes a hearing prosthesis 300 configured to make a comparison of a detected electrical phenomenon of the actuator 340 (e.g., impedance change) to an electrical phenomenon of a control signal sent to the actuator 340 and control the operation of the hearing prosthesis 300 (e.g., via control circuitry of the hearing prosthesis) based on the comparison. Further, an embodiment includes a hearing prosthesis 300 configured to compare a detected electrical phenomenon of the actuator 340 to an electrical phenomenon of a control signal sent to the actuator 340 (e.g., from processing section 330) and determine that the recipient of the hearing prosthesis is speaking based on the comparison.

Figure 8:
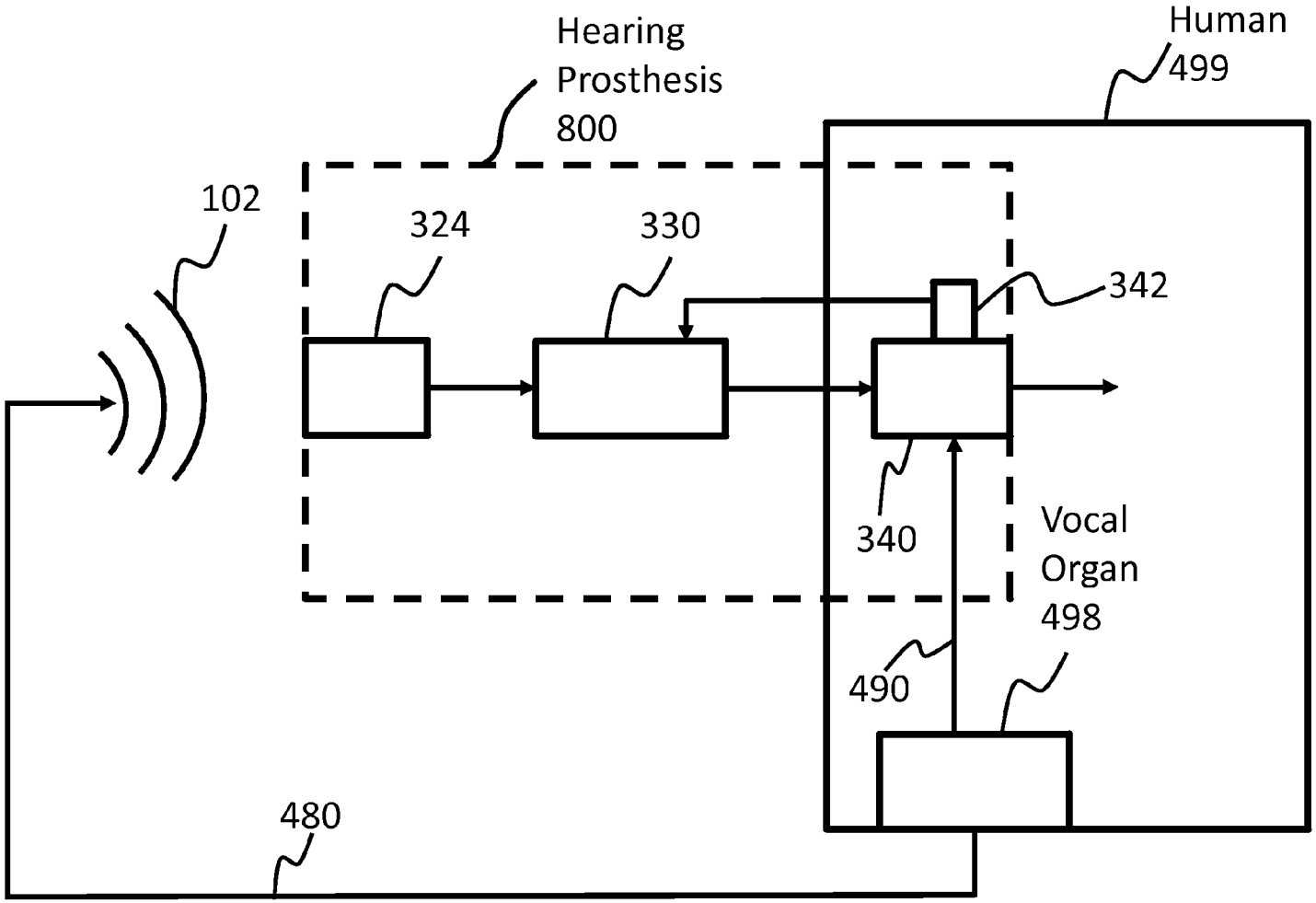
FIG. 8 is another functional diagram of a human recipient interacting with a prosthesis according to another exemplary embodiment.

FIG. 8 depicts an alternate embodiment of a hearing prosthesis in the form of a partially implantable hearing prosthesis (e.g., an active transcutaneous bone conduction device), although the concepts detailed herein in association with FIG. 8 are applicable to the other types of hearing perceives as detailed herein and are variations thereof. As can be seen, there is presented in FIG. 8 a hearing prosthesis 800 corresponding to any of those detailed herein and/or variations thereof, with like numbers of FIG. 8 corresponding to those of FIGS. 3-4C. Hearing prosthesis 800 includes transducer 342, which can be an accelerometer, which is in vibrational communication with actuator 340. That said, in an alternate embodiment, transducer 342 (e.g., accelerometer) can be in vibrational communication with tissue of the recipient that transmits or otherwise conducts vibrations. In the embodiment depicted in FIG. 8, the vibrations from the vocal organs 498 resulting from an own voice event travel through body tissue conduction (e.g. bone conduction) to the actuator 340, as in the embodiments detailed above. However, instead of utilizing the actuator 340 as a transducer/utilizing the input and/or output of the actuator 340 to obtain the phenomenon related to the actuator as detailed above, the accelerometer is utilized to do so.

As can be seen, the hearing prosthesis 300 is configured such that the accelerometer 342 outputs a signal to the processing section 330, although in alternate embodiments, the accelerometer 342 can output a signal to another device other than the processing section 330. In an exemplary embodiment, the processing section 330 is configured to evaluate the signal from the accelerometer 342 by, for example, comparing the signal to known data, such as data indicative of the vibrational characteristics of the actuator 340 actuating when provided a given control signal corresponding to that provided to the actuator 340 at the time that the signal from the accelerometer 342 was received. This aforementioned evaluation corresponding to method action 520 detailed above. Along these lines, in an exemplary embodiment, a database of data corresponding to various vibrational characteristics of the actuator 340 as determined from output from the accelerometer 342 can be developed for various given stimuli/signals sent to the actuator 340 in the absence of vibrational energy from an own voice event being received by the actuator 340. Thus, method action 520 can be executed by utilizing, by way of example only and not by way of limitation, a lookup table of the like, to determine what the vibrational characteristic should be for a given signal/stimuli in the absence of vibrational energy from an own voice event being received by the actuator 340, and comparing that vibrational characteristic to the actual vibrational characteristic obtained based on the output of the accelerometer 342. When using a digital signal processor with input and output fifos/buffers, the last buffer sent out can be used in lieu of a "lookup table" after adding some compensations of known properties of the system. In an alternative embodiment, method action 520 can be executed by calculating the characteristic based on the signal that will be sent from the digital signal processor or whatever pertinent component generates the signal and adding thereto a compensation factor of known behavior of the actuator and other properties that can affect resulting stimuli such as attachment to the skull (e.g., mechanical impedance sensed by actuator, compensations depending on choice of components etc.). Such expected signal can then be subtracted from the detected signal from accelerometer or actuator. The resulting signal can then be compared to a lookup table to determine if such signal resembles vibrational energy from own voice.

If the comparison of the actual vibrational characteristic obtained based on the output of the accelerometer 342 is different from that of the lookup table (meaningfully different, beyond that which could result from noise and/or tolerances of the system) or other source of comparison data, method action 530 will result in a determination that the actuator 340 is receiving vibrational energy from an own voice event, and thus the recipient is speaking.

Accordingly, in an exemplary embodiment, there is a device including a hearing prosthesis 300, further including an accelerometer 342 in vibrational communication with the actuator 340. In such an embodiment, the phenomenon related to the actuator 340 is vibration originating from vocalization of the recipient resulting in tissue conducted vibrations received by the actuator 340 and transferred to the accelerometer.

Figure 9:
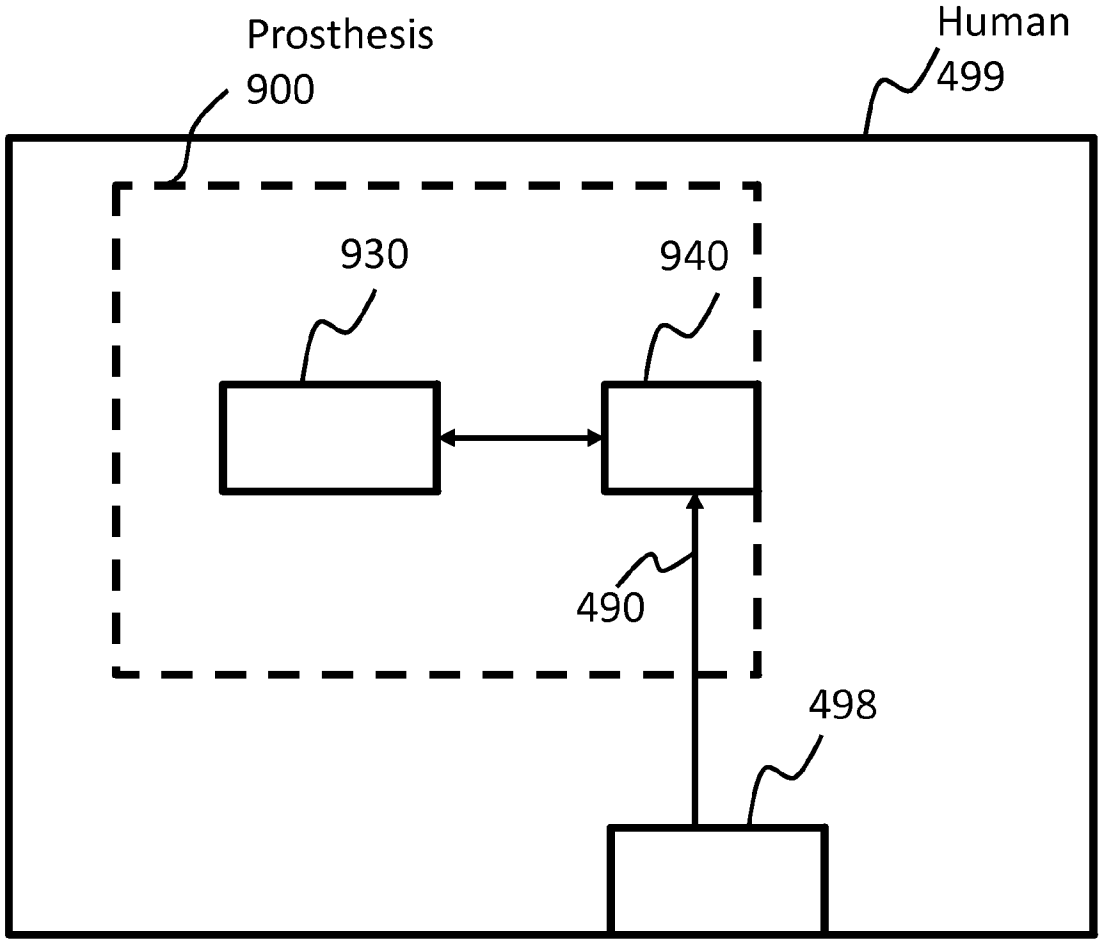
FIG. 9 is a functional diagram of a human recipient interacting with a prosthesis according to another exemplary embodiment.

FIG. 9 depicts an exemplary prosthesis 900. Prosthesis 900 is a totally implantable prosthesis. However, in an alternate embodiment, prosthesis 900 can be a partially implantable prosthesis. Prosthesis 900 is a passive prosthesis in that it does not provide stimulation to the recipient. Prosthesis 900 includes a processing section 930, which can correspond to the processing section 330 detailed above. Processing section 930 can be a digital signal processor or any type of processor that can enable the teachings detailed herein and/or variations thereof to be practiced. Prosthesis 900 also includes transducer 940. In the embodiment of FIG. 9, the transducer 940 receives vibrations resulting from body tissue conduction originating from the vocal organ 498. As with the embodiments detailed above, the processing section 930 can evaluate phenomenon associated with the transducer 940 (e.g. electrical characteristics) related to the vibrations received by the transducer 940. In an exemplary embodiment, prosthesis 900 is configured to compare data based on the phenomenon associated with the transducer 940 resulting from the vibrations to data stored in the prosthesis 900 (e.g., data stored in a lookup table based on prior phenomenon associated with the transducer 940) to determine whether or not an own voice event is occurring.

Figure 10:
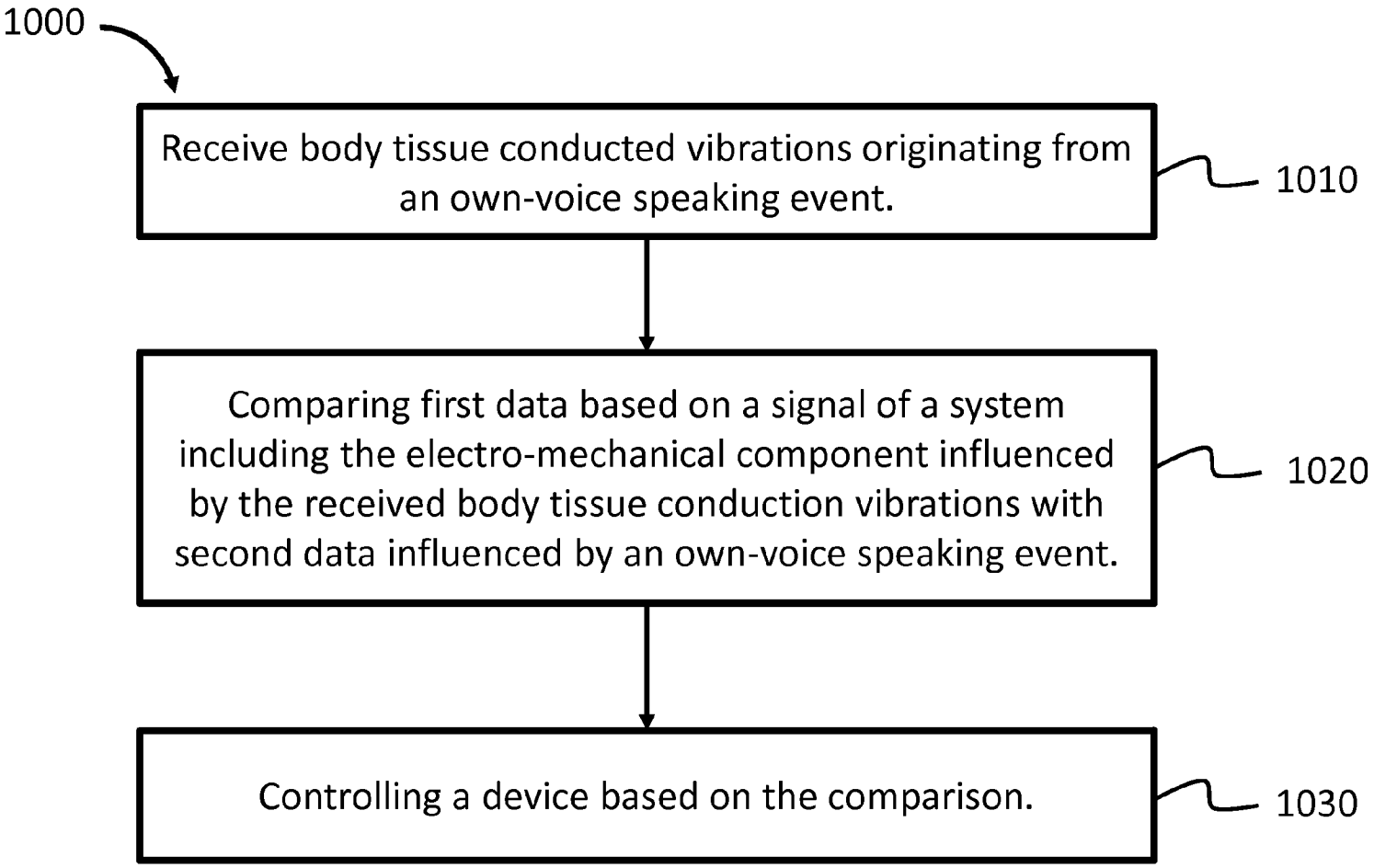
FIG. 10 is a flowchart of another exemplary method of an exemplary embodiment.

Now with reference to FIG. 10, that figure depicts a flowchart for an exemplary method 1000 that can be executed utilizing the devices and systems detailed herein and/or variations thereof to control a device (e.g., a hearing prosthesis or another voice activated/controlled device). Specifically, method 1000 includes method action 1010, which entails receiving body tissue conducted vibrations (e.g., bone conducted vibrations) originating from an own-voice speaking event with an electro-mechanical component. In an exemplary embodiment, the electro-mechanical component is implanted in a recipient. In an alternative embodiment, the electro-mechanical component is a component that is not implanted. In an exemplary embodiment, the component can be an actuator or a transducer in a pair of bone conduction glasses or a passive transcutaneous bone conduction device. Any placement of an electro-mechanical component that can enable the teachings detailed herein and/or variations thereof to be practiced can be utilized in at least some embodiments. In an exemplary method, this action can be accomplished by utilizing the hearing prosthesis 300 detailed above, the hearing prosthesis 700 detailed above and/or the hearing prosthesis 900 detailed above, or any other variation thereof, where, respectively, the actuator 340, the accelerometer 342 and the transducer 940 correspond to the electro-mechanical component implanted in the recipient.

Method 1000 further includes method action 1020, which entails comparing first data based on a signal of a system including the electro-mechanical component influenced by the received body tissue conducted vibrations (e.g., the system which includes the shunt resistor 605, the system which includes the accelerometer 342, etc.) with second data influenced by an own-voice speaking event.

In an exemplary embodiment, the first data can be data corresponding to any of those detailed herein and/or variations thereof. By way of example only and not by way of limitation, the first data can correspond to an electrical characteristic across the actuator 340 determined according to method action 510 detailed above. The first data can correspond to data based on the output of the accelerometer 342. The first data can correspond to data based on output of other devices. Any data that can enable the teachings detailed herein and/or variations thereof to be practiced can be utilized in at least some embodiments.

Still further, in an exemplary embodiment, the second data can be data from the processing section 330 corresponding to the output signal outputted to the actuator 340 to actuate the actuator to evoke a hearing percept. In this regard, referring back to FIGS. 4A-4C, the vocal organ 498 results in sound traveling along path 480 through the air to microphone 324, which outputs a signal to the processing section 330, which outputs a signal to the actuator 340 based on the received signal from the microphone. Thus, the signal outputted by the processing section 330 is a signal based on an own-voice speaking event, and, therefore, the signal constitutes data influenced by an own-voice speaking event (second data). Accordingly, method action 1020 can be practiced where the own-voice speaking event that influences the second data is the same own-voice speaking event that originates the body tissue conducted vibrations received in method action 1010.

Accordingly, in an exemplary embodiment, the second data is based on an output of a sound processor (which can correspond to processing section 330) of the hearing prosthesis 300, where the output of the sound processor is based on ambient sound that includes air-conducted sound originating from the own-voice speaking event captured by the microphone 324 of the hearing prosthesis 300.

That said, in an alternate embodiment, method action 1020 can be practiced where the own-voice speaking event that influences the second data is different from the own-voice speaking event that originated the body tissue conducted vibrations received in method action 1010. By way of example only and not by way of limitation, in an exemplary embodiment, the second data is data stored in look up table of like that is based upon a previous own-voice speaking event (of the recipient). Thus, the second data is based on a prior own voice event. In an exemplary embodiment, the processing section 330 can be configured to compare the first data to the second data and identify similarities between the two. By way of example only and not by way of limitation, similarities can be with respect to frequencies of a given word or words, etc. Any voice recognition routine that can enable method action 1020 to be practiced can utilize in at least some embodiments.

Accordingly, in an exemplary embodiment, the received body tissue conducted vibrations originating from an own-voice speaking event of method action 1010 can be received utilizing an implanted microphone or the like (e.g., the embodiment of FIG. 4B).

Method 1000 further includes method action 1030, which entails controlling the device (e.g., the hearing prosthesis) based on the comparison of method action 1020. In an exemplary embodiment, the device is the hearing prosthesis or other prosthesis. In an alternate embodiment, the device is a different device from a hearing prosthesis (some other voice activated device). Some exemplary aspects of control will be detailed below.

Figure 11:
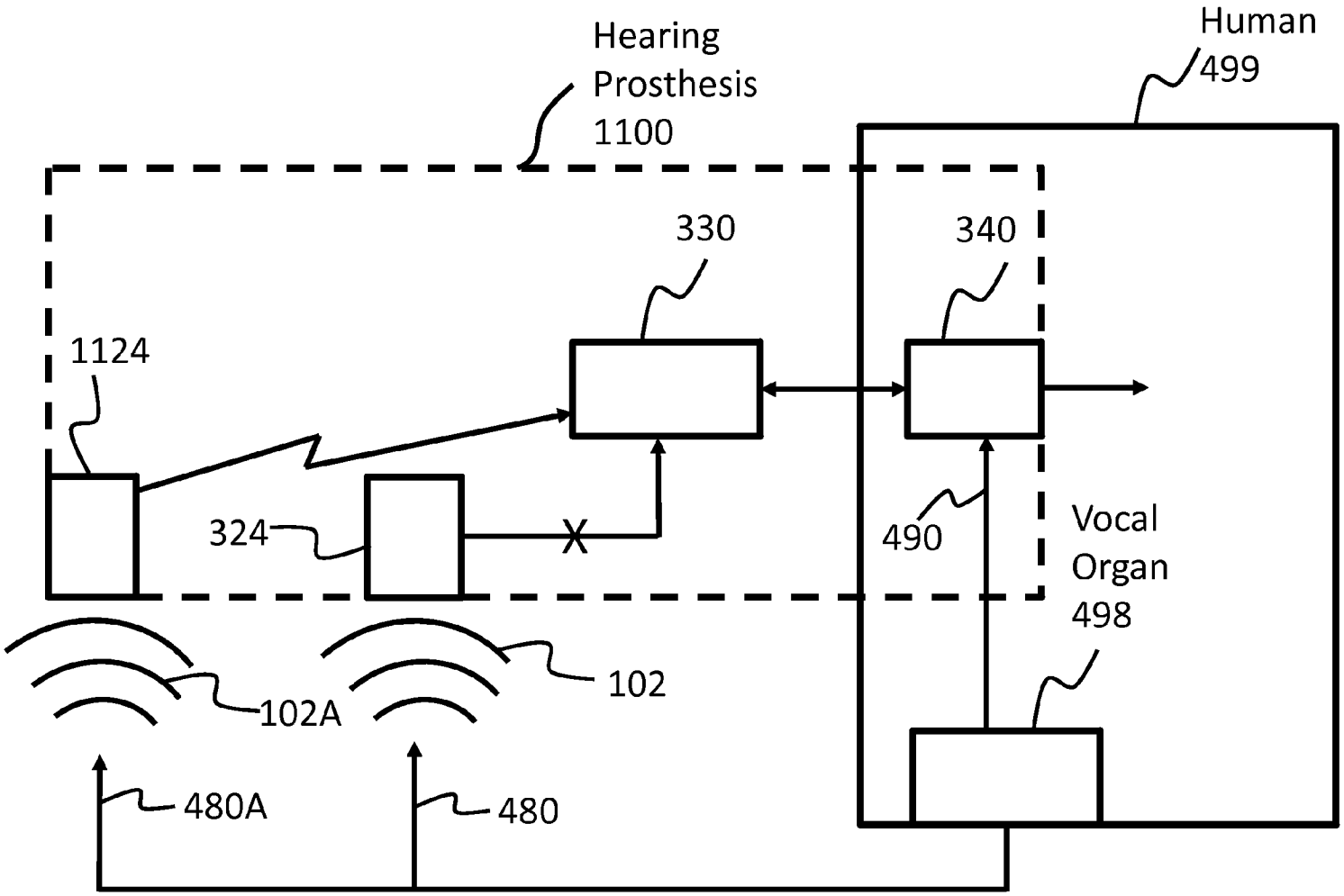
FIG. 11 is another functional diagram of a human recipient interacting with a prosthesis according to another exemplary embodiment.

As noted above, method 1000 can be executed utilizing at least some of the devices and systems detailed above. Method 1000 is further applicable to variations as detailed above such as, by way of example only and not by way of limitation, the embodiment of FIG. 11. FIG. 11 details a hearing prosthesis 1100 which corresponds to that of FIG. 4B in that it is partially implantable, however, the conceptual features of hearing prosthesis 1100 are applicable to the embodiments of FIGS. 4A and 4C is well.

Prosthesis 1100 includes a remote microphone 1124 that is in wireless communication with processing section 330. This is in contrast to microphone 324, which is in wired communication with the processing section 330. The embodiment of FIG. 11 has utilitarian value in that the remote microphone 1124 can be positioned remotely from the remainder of the hearing prosthesis 1100. By way of example only and not by way of limitation, a recipient can give the microphone 1124 to a speaker speaking to him or her, such that the speaker can place the microphone 1124 in front of his or her mouth, thereby improving the ability of the hearing process is 1100 to capture the particular sound of interest (i.e. the sound of the speaker speaking to the recipient). In the scenario where the remote microphone 1124 is being utilized to capture sound, as opposed to the microphone 324, which is in wired communication with the processor section 330 (and thus is likely not configured to be moved remotely from the remaining components (i.e., given to another person as just noted)), the output of microphone 324 is typically not utilized by a processing section 330, as indicated by the "X" over the signal path for microphone 324 to processing section 330 (the signal path of the microphone 324 can be blocked or otherwise "broken," the signal from microphone 324 received by processing section 330 can be ignored, etc.). Instead, as denoted by the wireless communication symbol in FIG. 11, the microphone 1124 wirelessly transmits the sound captured by that microphone to the processing section 330.

In at least some embodiments, the sound originating from the vocal organ 498 of the human 499 travels along a path 480A through the air, and the sound waves 102A impinge upon the microphone 1124 in a manner analogous to the impingement of sound waves 102 on the microphone 324. An exemplary embodiment utilizes a latency phenomenon associated with wireless communication to determine that an own voice event has taken place.

Specifically, the timing associated with the vibrations from the vocal organ 498 traveling through the body tissue to the actuator 340 (or accelerometer 342, or other implanted device) along 490 and then the detection thereof by the prosthesis via signal communication between the actuator 340 and the processing section 330 is faster relative to the timing associated with the combined speech traveling through the air along path 480A and then the outputted signal from the microphone 1124 resulting from the speech sounds impinging thereupon travelling over the wireless path from the microphone 1124 to the processing section 330. In at least some embodiments, the timing difference is due at least in part (in some embodiments, mostly, and in some embodiments, substantially) to the latency associated with the wireless communication between the microphone 1124 and the processing section 330. In an exemplary embodiment, this latency is about 20 ms relative to the timing associated with the actuator 340 (and/or an accelerometer 342). Accordingly, in an exemplary embodiment, the processing section 330 is configured to evaluate a coherency associated with input related to the actuator 340 (and/or accelerometer 342) and the input associated with the remote microphone 1124. If the processing section 330 determines that the coherency of the respective inputs are different (or at least different beyond a predetermined amount), the processing section 330 can determine that an own voice event has occurred or otherwise control the hearing prosthesis (or other device) accordingly.

Thus, in an exemplary embodiment of executing method 1000, the method is executed in a hearing prosthesis 1100, the second data is based on received wireless output of a microphone (microphone 1124) in wireless communication with a sound processor (e.g., processing section 330 of the hearing prosthesis 1100. The comparison of method action 1020 is a coherence comparison between the first data (which is based on the input from the actuator 340 and/or the accelerometer 342) and the second data. In an exemplary embodiment of this exemplary embodiment, method action 1030 entails controlling hearing prosthesis to utilize output from the microphone 342 instead of output from the microphone 1124. In this regard, in an exemplary embodiment, as noted above, microphone 324 is in wired communication with the processing section 330 of the hearing prosthesis 1100, and thus the latency associated with the utilization of the wireless communication between the microphone 1124 and processing section 330 can be eliminated. (The utilitarian value of such will be described in greater detail below, along with other exemplary control aspects).

Figure 12:
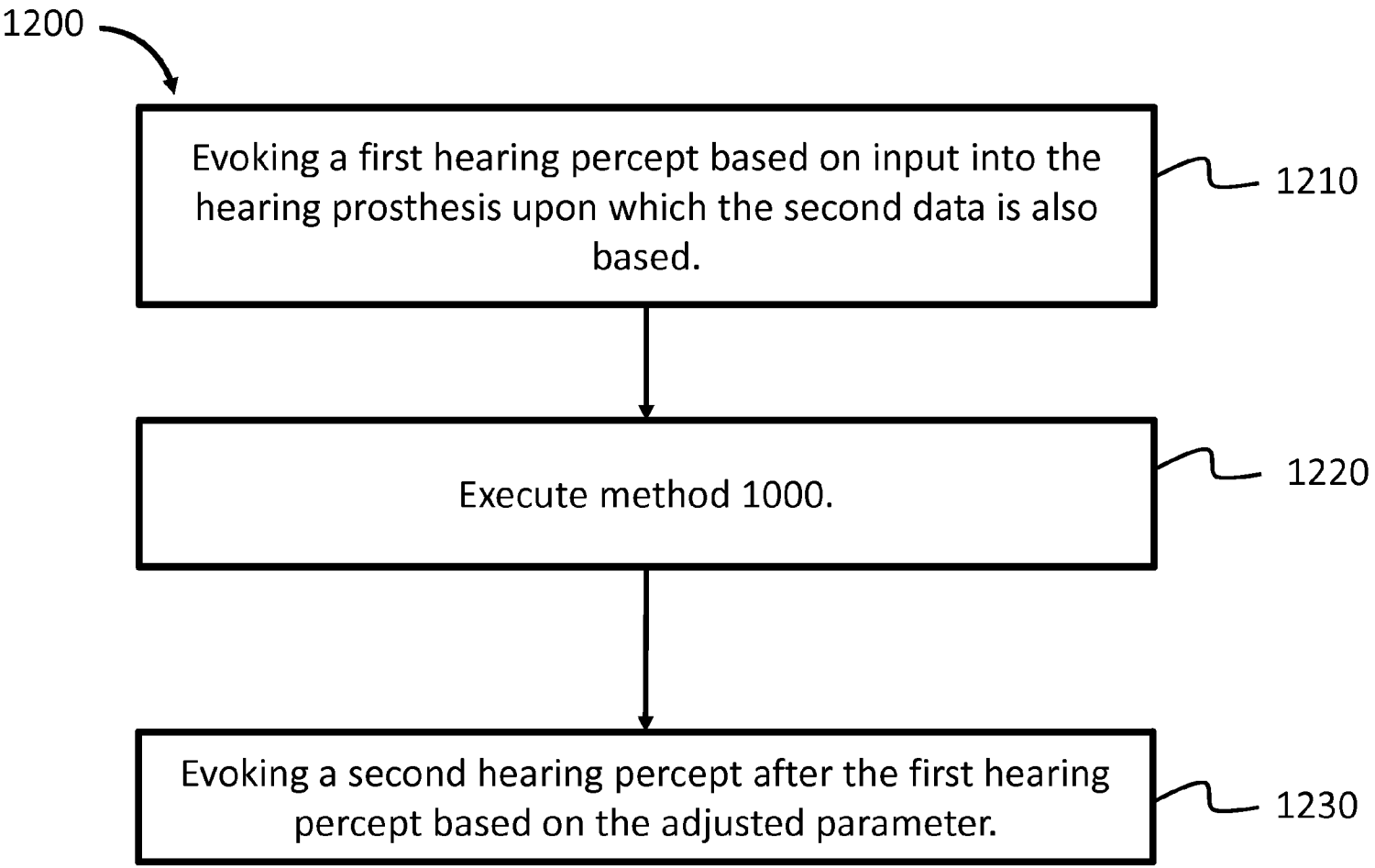
FIG. 12 is a flowchart of another exemplary method of an exemplary embodiment.

Further, FIG. 12 presents a flowchart presenting method 1200, which includes method action 1210, which includes evoking a first hearing percept based on input into the hearing prosthesis upon which the second data is also based. By way of example only and not by way of limitation, the first hearing percept can be based upon sound traveling along path 480 through the air to microphone 324 originating from the vocal organ 498. Method 1200 further entails method action 1220, which entails executing method 1000. In an exemplary embodiment, method action 1010 is executed by receiving body tissue conducted vibrations by the actuator 340 and/or the accelerometer 342, where the body tissue conducted vibrations originate from the same speaking event that created the input into the hearing prosthesis utilized in method action 1210. In an exemplary embodiment, method action 1030 is executed, when executing method action 1220, by adjusting a control parameter of the hearing prosthesis in response to the comparison resulting from executing method action 1020. This adjustment is an adjustment from a parameter relative to that of the hearing prosthesis when the first hearing percept was evoked.

Still with reference to FIG. 12, method 1200 further includes method action 1230, which entails evoking a second hearing percept after the first hearing percept based on the adjusted parameter adjusted when executing method action 1030 in method action 1220.

In an exemplary method, method actions 1210 and 1220 are executed as noted above, and then a second hearing percept is evoked based on a signal from a second microphone (e.g., microphone 324) in wired communication with a sound processor (e.g., processing section 330). In an exemplary embodiment, this has utilitarian value with respect to eliminating the latency associated with the wireless microphone noted above. Accordingly, an exemplary embodiment can include evoking a second hearing percept occurring after a first hearing percept, entailing muting a first microphone of the hearing prosthesis (e.g., such as a microphone the output of which the first hearing percept was based) and utilizing a second microphone of the hearing prosthesis, the signal from which is utilized at least in part to evoke the hearing percept.

Figure 13:
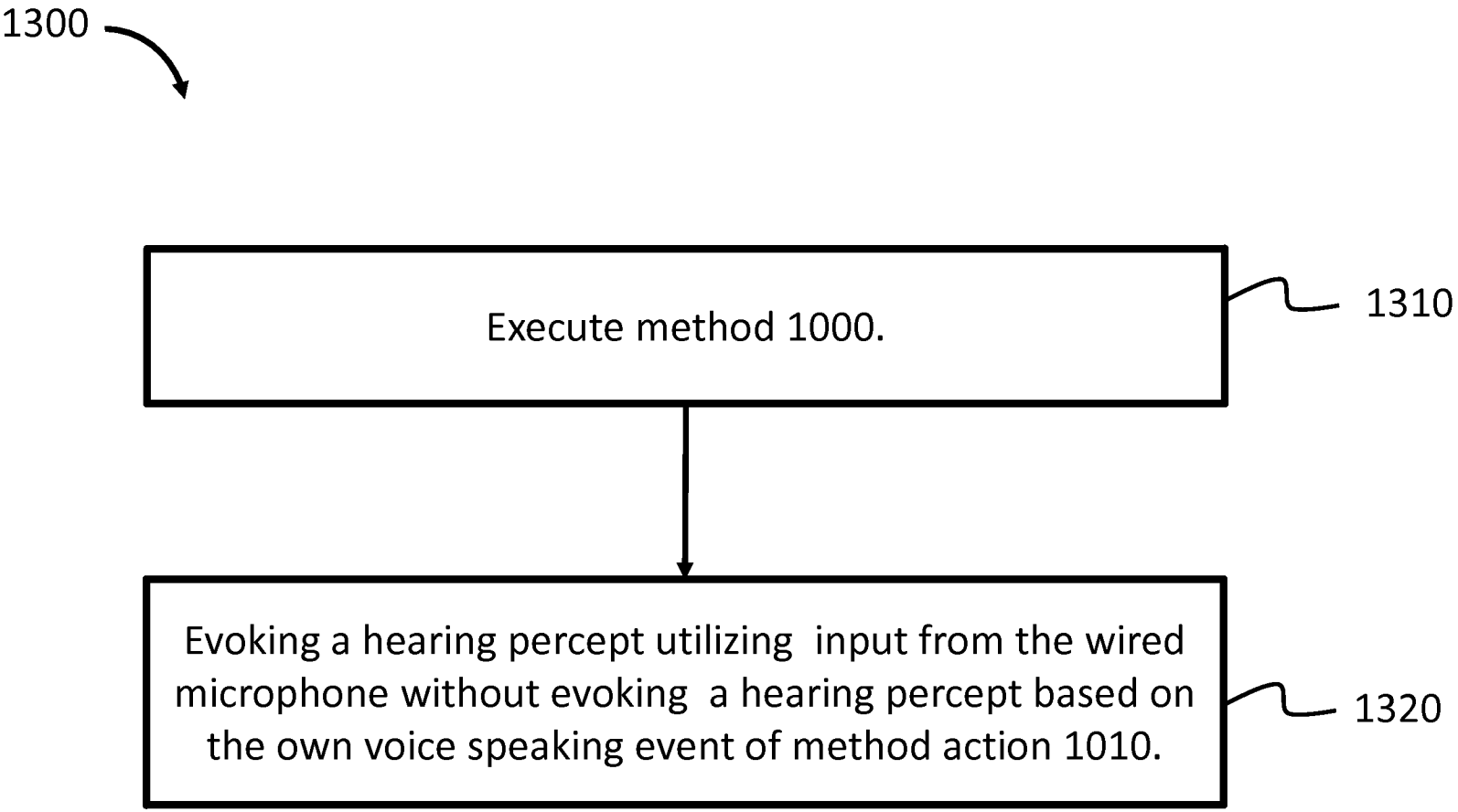
FIG. 13 is a flowchart of another exemplary method of an exemplary embodiment.

Still further, now with reference to FIG. 13, there is a method 1300 which is executed utilizing hearing prosthesis 1100. Method 1300 in some respects parallels method 1200, but method action 1210 is not executed. In this regard, the hearing prosthesis 1100 is configured to perform the coherence evaluation or the like (or other utilitarian comparison method actions) prior to evoking a hearing percept based on the received input from the remote microphone 1124. Accordingly, method action 1220 can be executed within the latency period associated with the remote microphone 1124. Further, the microphone can be switched from the remote microphone 1124 to the wired microphone 324 also within the latency period. Accordingly, method 1300 includes method action 1310, which entails executing method 1000, and method action 1320, which entails evoking a hearing percept utilizing the input from the wired microphone 324. Also, method 1300 is executed without evoking a hearing percept based on input from the remote microphone 1124 where the input from the remote microphone 1124 is based on sound originating from action of the vocal organ 498, where the received body tissue vibrations of method action 1010 also originate from the action of the vocal organ 498 that originates the sound. Put another way, method 1300 is executed without evoking a hearing percept based on input from the remote microphone 1124 where the input from the remote microphone 1124 is based on sound captured by the remote microphone 1124 that corresponds to the own-voice speaking event that originates the received body tissue conducted vibrations of method action 1010.

Figure 14:
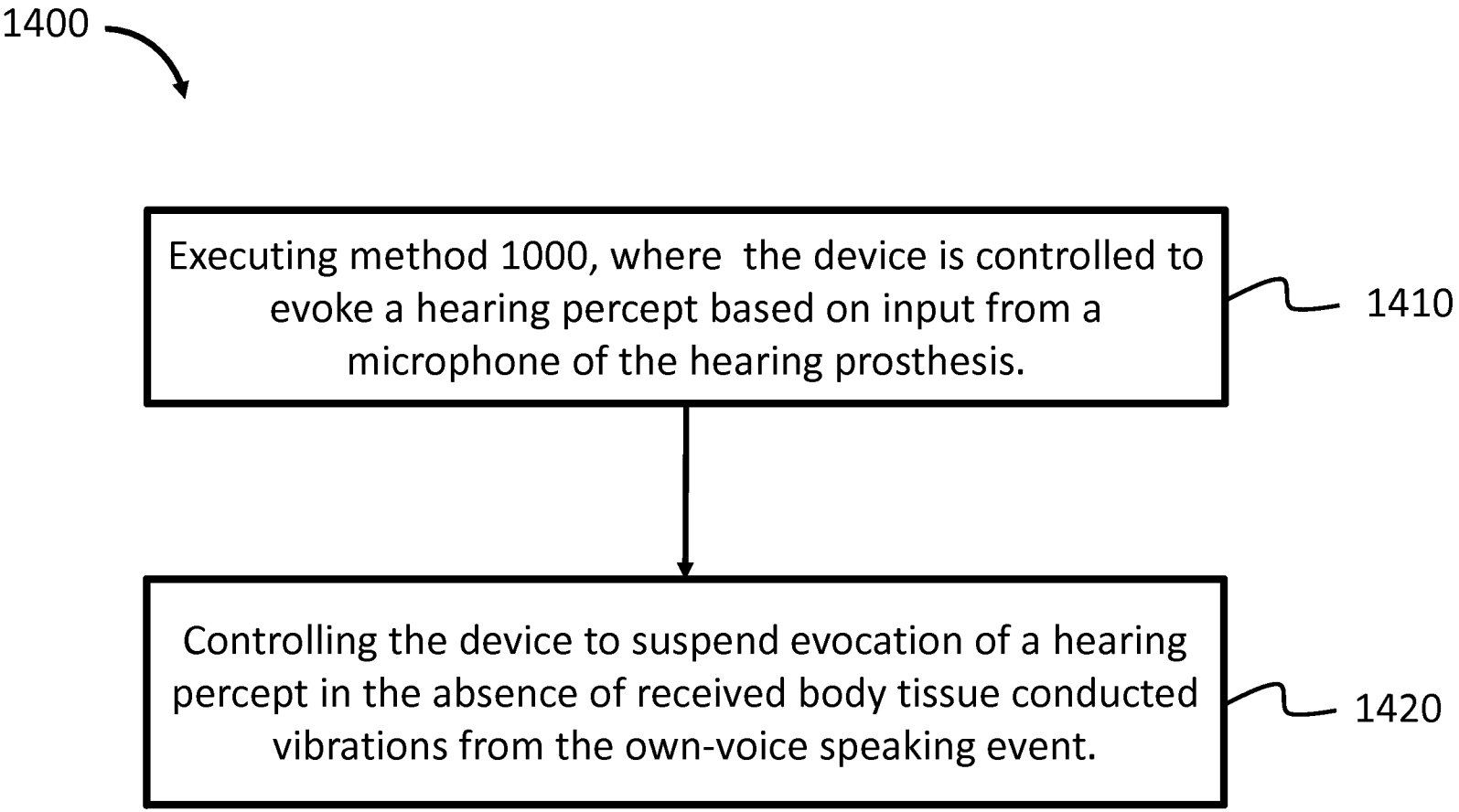
FIG. 14 is a flowchart of another exemplary method of an exemplary embodiment.

An exemplary use of method 1000 can be seen in FIG. 14, which presents a flowchart for a method 1400. Method 1400 includes method action 1410, which entails executing method 1000, where in method action 1030, based on the comparison, the device is controlled to evoke a hearing percept based on input from a microphone of the hearing prosthesis, where the second data is based on the input from the microphone. Accordingly, unlike some of the control regimes detailed herein where the invocation of a hearing percept is suspended during the own-voice event, method action 1410 entails controlling the hearing prosthesis to evoke a hearing percept during the own voice event.

Method 1400 further includes method action 1420, which entails controlling the device to suspend evocation of a hearing percept in the absence of received body tissue conducted vibrations from the own-voice speaking event.

In an exemplary embodiment, method 1400 can have utility with respect to treatments for stuttering, where the recipient can experience utilitarian value in "hearing" his or her own voice via, for example, a bone conducted hearing percept induced by a hearing percept (i.e., an artificially originated bone conduction hearing percept), in addition to the bone conduction hearing percept resulting from natural bone conduction from the vocal organ 498).

The above embodiments provide utilitarian devices, systems and/or methods to enable the hearing prosthesis to determine the occurrence of an own-voice speaking event, or at least otherwise be controlled in a given manner as a result of an own-voice speaking event.

As noted above, various comparisons are undertaken to enable the teachings detailed herein. It is noted that the comparisons can be absolute comparisons and also can be "tolerance based" comparisons. By way of example only and not by way of limitation, with respect to the coherence comparisons, a comparison between two sets of data can result in a determination that there is coherence even though the coherence is not exactly the same. A predefined range or the like can be predetermined and/or developed in real-time to account for the fact that there will be minor differences between two sets of data but the data is still indicative of a situation where, for example, an own-voice event is occurring. A predefined value and/or limit can be predetermined and/or developed in real-time that can be utilized as a threshold to determine whether or not a given comparison results in a determination of an own voice event occurring/data includes contents associated with an own voice event.

Further along these lines, in an exemplary embodiment, a comparison between the data based on the actuator 340 receiving vibrations resulting from own-voice body tissue conduction and the data based on the output of the processing section 330 may have a magnitude difference of about 5% or 10% or so. Accordingly, an exemplary embodiment includes a device and/or system and/or method that can enable a comparison based on such similar values. Moreover, in at least some embodiments, the prosthesis can be configured to utilize various ranges and/or differences between the signal recorded over the actuator and the output signal of the processing section 330 depending on different conditions. For example, temperature, age, ambient environmental conditions, etc., can impact the signal across the actuator. Still further, some embodiments can be configured to enable calibration of the prostheses to take into account scenarios that can cause "false positives" or the like. Moreover, the differences and/or ranges can be based on moving averages and the like and/or other statistical methods. Any form of comparison between two or more sets of data that can enable the teachings detailed herein and/or variations thereof can be utilized to practice at least some embodiments.

The teachings detailed herein can be utilized as a basis to control or otherwise adjust parameters of the device 300 and variations thereof. In at least some embodiments, upon a detection of at least one of the phenomenon indicative of the recipient of the hearing prosthesis speaking, and operation of a device, such as a hearing prosthesis, is controlled to reduce amplification of or otherwise cancel certain frequencies of captured sound (e.g., such as frequencies falling within a range of frequencies encompassing the recipient's own voice). Accordingly, a hearing prosthesis can continue to evoke a hearing precept, but the hearing percept will have a minimized own voice content and/or no own voice content. In this regard, in an exemplary embodiment, such as one utilizing the hearing prosthesis 300, the sound captured by microphone 324 is utilized by the processing section 330 to develop an output signal to be sent to actuator 340 to evoke a hearing percept. However, the processing section 330 processes the output of the microphone 324 to reduce and/or eliminate the own voice content of the output of the microphone 324. Conversely, if no determination is made that an own voice event is occurring, the processing section 330 processes the output of the microphone 324 in a normal manner (e.g. utilizing all frequencies equally to control the actuator 340 to evoke a hearing percept).

Thus, an exemplary embodiment can have utilitarian value for a hearing prosthesis, such as, by way of example only and not by way of limitation, a bone conduction device, where the recipient's own-voice is at least sometimes amplified to a level that is not as desirable as otherwise may be the case. By identifying the occurrence of an own voice event, this amplification can be prevented, or at least mitigated relative to that which would be the case in the absence of the identification of the own voice event. Indeed, in at least some exemplary embodiments, the determination that an own voice event has taken place can be utilized as a trigger to turn off the microphone of the hearing prosthesis and/or cancel any output of the processing section 330 to the actuator 340.

Moreover, an exemplary embodiment can have utilitarian value for hearing prosthesis, again such as by way of example only and not by way of limitation, a bone conduction device, which can sometimes have a latency that results in a recipient's own voice causing a reverberant sound and/or a percept analogous to that of an echo. By identifying the occurrence of an own voice event, this reverberant sound and/or echo percept can be minimized and/or eliminated relative to that which would be the case in the absence of such identification of the occurrence of an own voice event. It is noted that while the latency phenomenon as detailed herein primarily with respect to the use of the remote microphone, some hearing prostheses can result in latency utilizing the wired microphone. In this regard, in at least some embodiments, the teachings detailed herein can be utilized to reduce and/or eliminate phenomenon associated with latency of some hearing prosthesis.

With regard to the embodiments of FIG. 11, in an exemplary embodiment, the control of the operation of the hearing prosthesis based on the detection of an own voice event/the comparisons detailed herein and or variations thereof entails reducing amplification of the output of the remote microphone 1124 and/or canceling (e.g. ignoring) the output of the remote microphone 1124, and instead of utilizing the wired microphone 324 (or no microphone, instead relying on body tissue conduction to conduct the speech for the recipient to hear his or her own voice).

Figure 15:
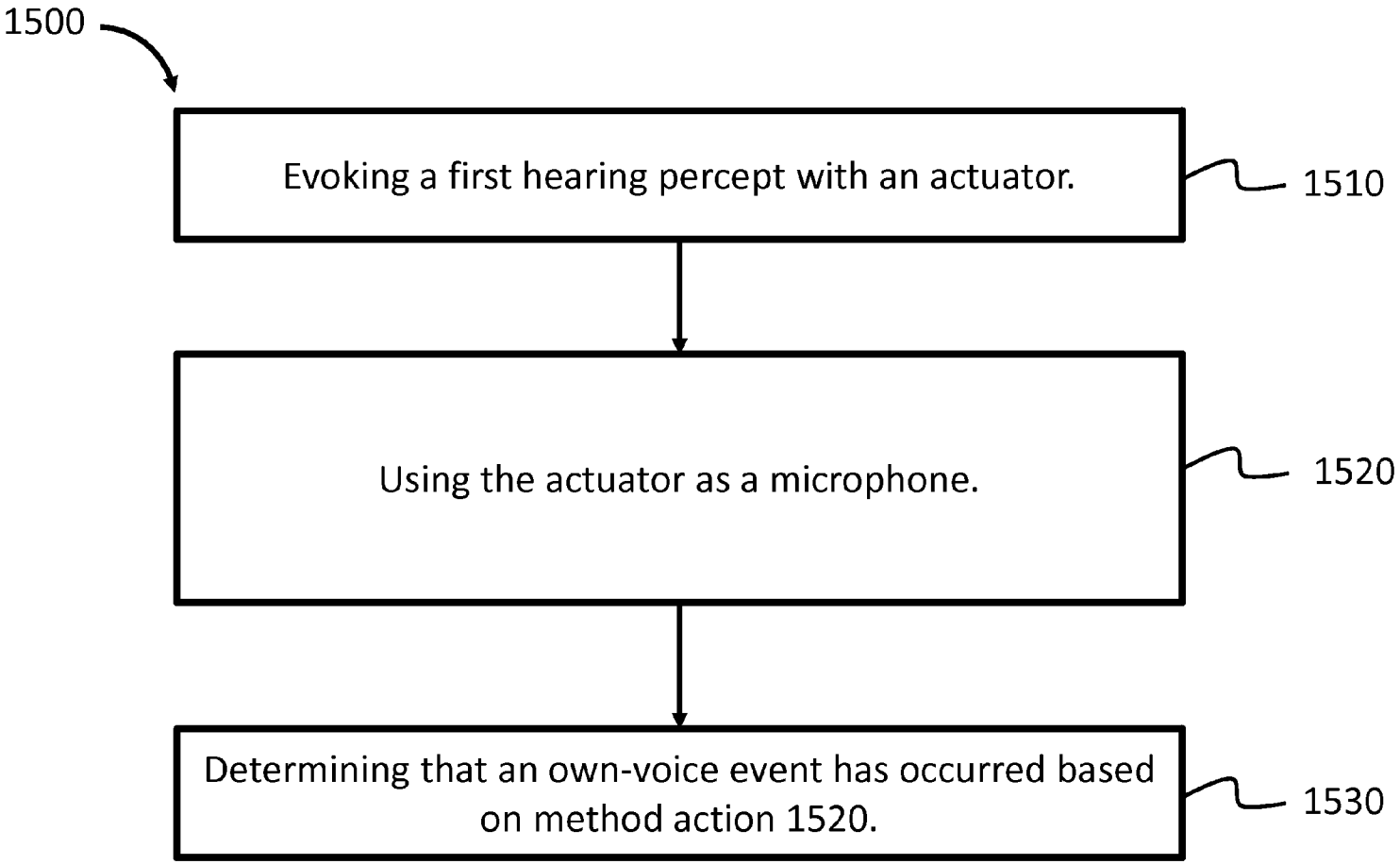
FIG. 15 is a flowchart of another exemplary method of an exemplary embodiment.

FIG. 15 presents flowchart for an exemplary embodiment that includes a method 1500 of reducing the effects of own-voice activity in a method of evoking a hearing percept with a hearing prosthesis, such as device 300 and the other devices detailed herein and variations thereof. This method 1500 includes method action 1510, which entails evoking a first hearing percept utilizing an implanted actuator (e.g., actuator 340). In an exemplary embodiment, this is performed during a period where no own-voice activity is occurring (e.g., the recipient of the hearing prosthesis is not vocalizing). Thus, the evoked hearing percept is based on ambient sound. The method further entails utilizing the actuator as a microphone (e.g., via analyzing one or more of the various phenomena related to the actuator as detailed above) in method action 1520. This action occurs after the evocation of the first hearing percept. The method also includes method action 1530, which entails determining that an own-voice event has occurred based on the action of utilizing the actuator as a microphone.

In an exemplary embodiment, the method further includes the action of reducing an own-voice echo percept relative to that which would be the case in the absence of the determination. In this regard, own-voice events can result in a reverberant sound in the event that there is latency with respect to processing sounds in the hearing prosthesis. In some situations, this latency can be perceived by the recipient as an echo. Accordingly, the aforementioned exemplary embodiment reduces the own-voice echo percept. It is noted that "reduces" also includes eliminating the echo percept.

The method can further include the action of evoking a second hearing percept after the first hearing percept, wherein a feature of the evoked hearing percept is based on the determination. In an exemplary embodiment of such a method action, an amplitude of an own-voice component of the second hearing percept is reduced based on the determination relative to that which would be the case in the absence of the determination (e.g., the determination prompts the hearing prosthesis to reduce the amplitude—the absence of a determination would not prompt the hearing prosthesis to reduce the amplitude). Alternatively, or in addition to this, the method can also include not evoking a third hearing percept based on the determination (the third hearing percept can exist whether or not the second hearing percept is evoked—that is, the term "third" is simply an identifier). This can result in a perception of silence by the recipient. This can prevent hearing percepts of unpleasant sounds (e.g., loud sounds) at the cost of not hearing ambient sounds. It is noted that as with the action of evoking the second hearing percept, the action of not evoking the third hearing percept can also reduce an echo percept relative to that which would be the case in the absence of the determination.

An exemplary embodiment of this method includes the action of determining that an own-voice event has occurred by comparing output from a microphone (e.g., microphone 324) of the hearing prosthesis 300 to output of the actuator (e.g., actuator 340) used as a microphone.

It is noted that in at least some embodiments, the teachings detailed herein and variations thereof can be utilized to detect distortion of the actuator in a device diagnosed mode. By way of example only and not by way of limitation, phenomenon related to the actuator (e.g., the voltage across the actuator, the impedance etc.) can be analyzed to determine whether or not the hearing prosthesis is malfunctioning with respect to the operation of the actuator.

Additionally, the teachings detailed herein and variations thereof can be utilized to detect body noise events other than own voice events. By way of example only and not by way of limitation, chewing body conducted sounds can be detected, and the device can be controlled to reduce and/or eliminate any chewing sounds in an evoked hearing percepts.

It is noted that any disclosure with respect to one or more embodiments detailed herein can be practiced in combination with any other disclosure with respect to one or more other embodiments detailed herein. It is further noted that some embodiments include a method of utilizing a hearing prosthesis including one or more or all of the teachings detailed herein and/or variations thereof. In this regard, it is noted that any disclosure of a device and/or system herein also corresponds to a disclosure of utilizing the device and/or system detailed herein, at least in a manner to exploit the functionality thereof. Corollary to this is that any disclosure of a method also corresponds to a device and/or system for executing that method. Further, it is noted that any disclosure of a method of manufacturing corresponds to a disclosure of a device and/or system resulting from that method of manufacturing. It is also noted that any disclosure of a device and/or system herein corresponds to a disclosure of manufacturing that device and/or system.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A hearing prosthesis, comprising:

a bone conduction actuator or a mechanical actuator configured to directly impart mechanical energy onto a cochlea configured to evoke a hearing percept via actuation thereof, wherein the hearing prosthesis is configured to make a detection of at least one phenomenon related to the actuator that is indicative of a recipient of the hearing prosthesis speaking; and control circuitry, wherein the control circuitry is configured to control an operation of the hearing prosthesis based on the detection, wherein the at least one phenomenon is an electrical phenomenon of the actuator, the hearing prosthesis is configured to make a comparison of the detected phenomenon to an electrical phenomenon related to a control signal sent to the actuator, and the control circuitry is configured to control the operation of the hearing prosthesis based on the comparison.

2. The hearing prosthesis of claim 1, wherein the actuator is configured to actuate in response to an electrical signal sent thereto along an electrical signal path leading to the actuator, wherein the phenomenon is an electrical phenomenon of the signal path.

3. The hearing prosthesis of claim 1, wherein the phenomenon is at least one of voltage, current, resistance or inductance of a system of which the actuator is a part.

4. The hearing prosthesis of claim 1, wherein the phenomenon is a voltage of a system of which the actuator is a part.

5. The hearing prosthesis of claim 1, further including an accelerometer that is in vibrational communication with at least one of the actuator or tissue of the recipient, wherein the phenomenon is vibration originating from vocalization of the recipient resulting in body tissue conducted vibrations received by the actuator and transferred to the accelerometer.

6. A method for a hearing prosthesis, comprising:

receiving body tissue conducted vibrations originating from an own-voice speaking event of a recipient with an electro-mechanical component;

comparing first data based on a signal of a system including the electro-mechanical component influenced by the received body tissue conducted vibrations with second data influenced by an own-voice speaking event; and controlling hearing prosthesis based on the comparison, wherein the receiving of body tissue conducted vibrations, the comparing first data and the controlling of the hearing prosthesis are executed by the hearing prosthesis.

7. The method of claim 6, wherein:

the own-voice speaking event that influences the second data is the same own-voice speaking event that originates the body tissue conducted vibrations.

8. The method of claim 6, wherein:

the second data is based on an output of a sound processor of the hearing prosthesis; and the output is based on ambient sound that includes air-conducted sound originating from the own-voice speaking event captured by a microphone of the hearing prosthesis.

9. The method of claim 6, wherein:

the second data is data based on a prior own voice event.

10. The method of claim 6, wherein:

the second data is based on received wireless output of a first microphone in wireless communication with a sound processor of the hearing prosthesis; and the comparison is a coherence comparison between the first data and the second data.

11. The method of claim 10, further comprising:

evoking a first hearing percept based on input upon which the second data is also based; after evoking the first hearing percept, evoking a second hearing percept based on a signal from a second microphone in wired communication with the sound processor.

12. The method of claim 10, further comprising:

evoking a hearing percept based on a signal from a second microphone in wired communication with the sound processor without evoking a hearing percept based on a signal from the first microphone based on the own-voice speaking event that originates the received body tissue conducted vibrations.

13. The method of claim 6, further comprising:

evoking a first hearing percept based on input upon which the second data is also based; adjusting a control parameter of the system in response to the comparison relative to that of the system when the first hearing percept was evoked; and after evoking the first hearing percept, evoking a second hearing percept based on the adjusted parameter.

14. The method of claim 6, wherein:

the electro-mechanical component is implanted in the recipient.

15. A method executed with a hearing prosthesis, comprising:

evoking a first hearing percept utilizing a bone conduction actuator or a mechanical actuator configured to directly impart mechanical energy onto a cochlea;

utilizing the actuator as a microphone;

making a determination that an own-voice event has occurred based on the utilization of the actuator as a microphone; and evoking a second hearing percept with the actuator after the first hearing percept, wherein the hearing prosthesis is controlled based on the determination such that a feature of an own-voice component of the second hearing percept is reduced relative to that which would be in the absence of the determination, wherein the evoking of the first hearing percept, the utilization of the actuator as a microphone, the making of the determination and the evoking of the second hearing percept are executed by the hearing prosthesis.

16. The method of claim 15, further comprising:

reducing an own-voice echo percept relative to that which would be the case in the absence of the determination.

17. The method of claim 15, further comprising not evoking a third hearing percept with the actuator based on the determination.

18. The method of claim 17, wherein:

the action of evoking the second hearing percept and the action of not evoking the third hearing percept reduces an own-voice echo percept relative to that which would be the case in the absence of the determination.

19. The method of claim 15, wherein:

the action of determining that an own-voice event has occurred includes comparing output from a microphone of the hearing prosthesis to output of the actuator used as a microphone.

20. The method of claim 17, wherein:

an amplitude of an own-voice component of the second hearing percept is reduced based on the determination relative to that which would be the case in the absence of the determination.

21. The method of claim 17, wherein:

the action of evoking the second hearing percept entails muting a first microphone of the hearing prosthesis and utilizing a second microphone of the hearing prosthesis, the signal from which is utilized at least in part to evoke the second hearing percept.

22. The method of claim 15, wherein:

the action of evoking a first hearing percept includes energizing the actuator such that a first part of the actuator moves relative to a second part of the actuator to generate vibrations which evoke the first hearing percept; and the action of using the actuator as a microphone include moving the first part relative to the second part to generate an electrical signal.

* * * * *